US009457207B2

(12) United States Patent
Waterford

(10) Patent No.: US 9,457,207 B2
(45) Date of Patent: Oct. 4, 2016

(54) FACEMASK WITH FILTER INSERT FOR PROTECTION AGAINST AIRBORNE PATHOGENS

(71) Applicant: Waterford Mask Systems Inc., Deerfield Beach, FL (US)

(72) Inventor: Steve Waterford, Deerfield Beach, FL (US)

(73) Assignee: WATERFORD MASK SYSTEMS INC., Deerfield Beach, FL (US)

( * ) Notice: Subject to any disclaimer, the term of this patent is extended or adjusted under 35 U.S.C. 154(b) by 0 days.

(21) Appl. No.: 14/801,808

(22) Filed: Jul. 16, 2015

(65) Prior Publication Data

US 2015/0314148 A1 Nov. 5, 2015

Related U.S. Application Data

(63) Continuation-in-part of application No. 14/477,840, filed on Sep. 4, 2014, now abandoned.

(60) Provisional application No. 61/873,400, filed on Sep. 4, 2013.

(51) Int. Cl.

*A62B 23/02* (2006.01)
*A62B 18/08* (2006.01)
*A41D 13/11* (2006.01)

(52) U.S. Cl.

CPC ..... *A62B 18/08* (2013.01); *A62B 18/082* (2013.01); *A62B 18/084* (2013.01); *A62B 23/02* (2013.01); *A62B 23/025* (2013.01); *A41D 13/1161* (2013.01); *A41D 13/1192* (2013.01)

(58) Field of Classification Search

CPC ..... A61M 16/06; A61M 2016/0661; A61M 16/105–16/107; A61M 2210/0606; A61M 2210/0618; A41D 13/11–13/1192; A62B 18/00; A62B 18/003; A62B 18/02; A62B 18/025; A62B 18/04; A62B 18/045; A62B 18/06; A62B 18/08; A62B 18/084

See application file for complete search history.

(56) References Cited

U.S. PATENT DOCUMENTS 2,067,026 A * 1/1937 Schwartz ..... A41D 13/11 128/206.12
2,201,315 A 5/1940 William (Continued)

FOREIGN PATENT DOCUMENTS

CA 1123705 A 5/1982
WO 0224279 A1 3/2002

(Continued)

OTHER PUBLICATIONS

Invitation to Pay Additional Fees dated Jan. 5, 2015 in connection with PCT/US2014/054163.

(Continued)

*Primary Examiner* — Justine Yu
*Assistant Examiner* — Tu Vo
(74) *Attorney, Agent, or Firm* — Corridor Law Group, P.C.

(57) ABSTRACT

A facemask assembly includes one or more airflow vents in a lower front section of the mask as well as within the nasal area. The airflow vent allow for the outflow of exhaled heat and $CO_2$. The airflow vents can be configured to direct inward airflow to strike an interior air filter. In some embodiments the airflow strikes the air filter at an oblique angle. The particulate capturing air filter can be replaceable. In some embodiments the air filter contains biocidal elements. In some embodiments the internal filter design enhances the capture of exhaled $H_2O$ which activates silver ions in the filter material creating a biocidal environment. In some embodiments, the facemask has two snap-in zones—one below the nose and one under the chin that can accommodate a wide variety of straps/tubing/O-ring stock and be secured behind the head via tying or various cord locks.

11 Claims, 30 Drawing Sheets

(56) References Cited

U.S. PATENT DOCUMENTS 2,410,454 A 11/1946 Motsinger
2,540,567 A 2/1951 Bennett
2,655,656 A 10/1953 Moeller
2,845,927 A * 8/1958 Hill ..... A62B 23/025 128/206.17
2,964,038 A 3/1960 Silverman
2,983,271 A 5/1961 Beck
3,130,722 A 4/1964 Dempsey et al.
3,137,296 A 6/1964 Gurtowski
3,152,588 A * 10/1964 Rogowski ..... A41D 13/11 128/206.12
3,154,073 A 10/1964 Klinger
3,276,445 A * 10/1966 Langdon ..... A62B 23/025 128/206.15
4,062,357 A 12/1977 Laerdal
4,296,746 A * 10/1981 Mason, Jr. ..... A41D 13/1146 128/201.12
4,653,124 A * 3/1987 McNeal ..... A61F 9/029 128/206.21
4,688,567 A * 8/1987 Kikuchi ..... A62B 23/02 128/206.15
4,976,857 A * 12/1990 Solomon ..... A62B 23/02 210/493.5
5,148,550 A * 9/1992 Hodgkinson ..... A42B 3/20 2/424
5,191,882 A * 3/1993 Vogliano ..... A62B 18/084 128/206.23
5,320,096 A * 6/1994 Hans ..... A61M 16/1045 128/201.13
5,353,789 A * 10/1994 Schlobohm ..... A62B 18/025 128/206.17
5,427,092 A 6/1995 Shiao
5,584,078 A 12/1996 Saboory
5,682,879 A 11/1997 Bowers
6,119,694 A 9/2000 Correa et al.
6,161,540 A * 12/2000 Fecteau ..... B01D 39/1623 128/205.27
6,691,314 B1 * 2/2004 Grilliot ..... A62B 17/04 128/201.25
6,981,503 B1 * 1/2006 Shapiro ..... A61M 16/0683 128/207.11
7,311,764 B2 * 12/2007 Friday ..... A62B 23/02 128/201.25
2004/0216745 A1 11/2004 Yuen et al.
2005/0056286 A1 * 3/2005 Huddart ..... A61M 16/06 128/206.21
2006/0201511 A1 9/2006 Freriks et al.
2007/0175480 A1 * 8/2007 Gradon ..... A61M 16/0638 128/207.11
2008/0223370 A1 * 9/2008 Kim ..... A41D 13/11 128/206.17
2009/0114228 A1 * 5/2009 Kirschner ..... A62B 23/025 128/206.13
2009/0151733 A1 * 6/2009 Welchel ..... A62B 23/025 128/863
2009/0151734 A1 6/2009 Park
2010/0126504 A1 * 5/2010 Johnstone ..... A41D 13/1184 128/202.13
2010/0268131 A1 * 10/2010 Efthimiou ..... A62B 7/10 601/47
2012/0132209 A1 5/2012 Rummery et al.
2013/0074845 A1 3/2013 Smith et al.

FOREIGN PATENT DOCUMENTS

WO 2013027174 A1 2/2013
WO 2013094806 A1 6/2013

OTHER PUBLICATIONS

Office Action issued Jan. 16, 2015 in connection with U.S. Appl. No. 14/477,840.

International Search Report and Written Opinion dated Apr. 22, 2015 in connection with PCT/US2014/054163.

* cited by examiner

FACEMASK WITH FILTER INSERT FOR PROTECTION AGAINST AIRBORNE PATHOGENS

CROSS-REFERENCE TO RELATED APPLICATION(S)

This application is a continuation-in-part of U.S. patent application Ser. No. 14/477,840 entitled "Facemask with Filter Insert for Protection Against Airborne Pathogens" filed on Sep. 4, 2014. The '840 application claimed priority benefits, in turn, from U.S. Provisional Patent Application Ser. No. 61/873,400 filed on Sep. 4, 2013, entitled "Facemask with Filter Insert for Protection Against Airborne Pathogens". Each of the '840 non-provisional and '400 provisional applications is hereby incorporated by reference herein in its entirety.

FIELD OF THE INVENTION

The present invention relates to facemasks and, in particular, to a facemask that includes a filter insert designed to protect the wearer, the patient and others in the vicinity of the wearer, from airborne pathogens. In some embodiments the mask can also include a protective eye shield and sound-resonating diaphragms.

BACKGROUND OF THE INVENTION

In the medical field, surgical masks are often used as a form of protection against airborne pathogens, including bacteria and viruses. Facemasks are typically worn over the mouth and nose of the wearer, and can incorporate a form of eye protection. These masks can also provide similar benefits in non-medical environments. For example, they can be used in environments with high levels of large airborne particulates or allergens, or where the wearer wishes to avoid physical contact between environmental pathogens and their mouth and nose.

Since the early 1900's, surgical masks have been in widespread use to help prevent infection of surgical wounds from staff-generated nasal and oral bacteria. According to the National Institute for Occupational Safety and Health (NIOSH), three clinical studies conducted in the 1980's and 90s found no difference in surgical infection rates when staff did not wear surgical masks. NIOSH also published that to be effective in reducing a wearer's exposure to airborne substances, a respiratory protection device needs to have sufficient fit as well as high filtration efficiency. NIOSH also stated that a recent laboratory study of five surgical masks with "good" filters found that 80-100% of subjects failed an OSHA-accepted qualitative fit test. (See CDC—NIOSH Science Blog—N95 Respirators and Surgical Masks at http://blogs.cdc.gov/niosh-scienceblog/2009/10/n95/).

Removing airborne pathogens and environmental allergens is not only very important in environments that require high levels of air purity, such as hospitals, but also in homes of people suffering from allergic responses to allergens. Additionally, wearers suffering from respiratory infections would benefit from the removal of pathogens and allergens when out in public.

Conventional designs focus on protecting patients from potentially harmful exhalations from the medical professional. Such designs trap vapor and liquid droplets in exhalations that contain potential airborne pathogens, thereby preventing them from contacting the patient and others in the vicinity of the wearer. These masks also provide limited protection for the medical professional by forming a physical barrier over the wearer's mouth and nose, preventing the accidental touching of these areas or the inhalation of airborne particles or droplets.

Previous designs can attach to the wearer's head by means of tie straps or headbands. These designs can also attach through nonadjustable holes cut into the mask designed to fit around the wearer's ear. Alternatively, they can also fasten using elastic straps around the head or ears. Rectangular cross-sectional elastics are often used, which can cause discomfort by stretching or pinching the skin around the ears and back of the head and by being one-size-fits-all and non-adjustable.

Conventional mask designs generally do not include a biocide-coated insert. They rely instead on droplet-trapping fabrics and physical barriers for protection. Those that do incorporate such inserts often require the wearer to rupture an envelope through physical force to become operable. This rupturing requirement can introduce problems such as the wearer forgetting to rupture the envelope, the wearer being unable to rupture the envelope or an accidental premature rupturing, rendering the biocidal substance ineffective.

In conventional designs, wearer's exhalations are generally directed out through the mask in front of the wearer. Airborne pathogens not entrapped by the mask are effectively sent directly towards the patient. Additionally, these masks often provide a poor seal between the mask and the face due to the force of exhalations and non-adjustable elastic fittings that do not fit snuggly around the wearer's head facial area.

Respirators with a NIOSH rating of N95-100 are more commonly used in environments where greater protection is required than that provided by surgical masks. Yet, these designs suffer from the inherent flaws:

(1) ties or elastic strap connections that connect along the sides of the mask near parallel to the upper nose seal area and thus, when sufficiently tied or tensioned to seal against the face, simultaneously pull the mask away from the upper nose seal area, preventing a complete seal;

(2) wearers have the option of improperly fitting the mask to their face and/or insufficiently pinching inward the conformable strip in a generic nose bridge area;

(3) little or no upward lift is provided by either ties or elastic straps for a proper seal in the chin area; and (4) exhalations inherently contain body heat, water ($H_2O$) and Carbon Dioxide ($CO_2$) and existing N95~100 masks, ultimately capture and restrict breathability due to the accumulation of water then clogging the mask membrane to the degree that masks that include a front, one-way valve allow the emission of much of an amount of the above, the area above that vent inherently captures it all and restricts breathability and functionality while also creating discomfort for the wearer.

Accordingly, a mask that secures snuggly and comfortably to the wearer's face with an adjustable and comfortable elastic design, and that also includes a replaceable biocidal insert designed to capture the emitted $H_2O$ to activate the silver biocidal ions, yet allows for the venting of heated, $CO_2$-laden air would more effectively protect both the wearer, the patient and others in the vicinity of the wearer.

The present improved facemask designs overcome shortcomings and disadvantages of prior designs by incorporating a continuous strap that is integrated with the nose bridge to generate a tri-directional force directed downwardly and approximately perpendicularly to the nose at the nose bridge area. The continuous strap, or nose bridge clip with strap, is placed at the nose bridge location in a manner that is customized to the wearer's face and not in a generic, non-adjustable position. The continuous strap construction pulls the mask upward below the chin while simultaneously pulling the mask backward into the face.

SUMMARY OF THE INVENTION

Shortcomings of conventional facemasks are overcome by a facemask comprising at least one airflow intake in a lower front section thereof. The at least one airflow intake capable of directing inward airflow to strike an interior air filter at an oblique angle.

The air filter can be replaceable and/or biocidal.

In an embodiment, the facemask has no directly front-facing openings. The facemask preferably further comprises air channeling features that direct exhalations downward and backward towards the wearer's neck. The facemask preferably further comprises a continuous strap structure with a semi-rigid lower section extending towards the wearer's ears and a plurality of spaced extrusions with a gap between each extrusion. The lower strap section preferably extends behind the wearer's ears and a flexible section curves in a semi-circular manner at a common distance.

The facemask preferably further comprises an elastic section that extends forward therefrom to complete the continuous strap in front of the wearer's face.

The facemask preferably further comprises a nose clip section within a forward-most center section of the continuous strap section and a pair of downwardly-facing lobe extrusions.

The facemask preferably further comprises a pair of through-holes formed within a flexible center structure. The through-holes are preferably spaced equidistantly between the pair of lobe extrusions. The facemask preferably further comprises a pair of hollowed extrusions along the topmost interior rim on either side of the curved topmost section. A pair of flexible circular openings is preferably formed on either side of the wearer's mouth, each of which has interior channels suitable for mounting at least one resonating diaphragm.

The facemask can further comprising a transparent eye shield comprising a pair of extrusions insertable into the pair of through-holes such that the eye shield is secured to the wearer's nose area and inclined inward to rest the top portion against the wearer's forehead.

In another embodiment, a facemask comprises:

(a) at least one air vent for bidirectional flow of air being inhaled and exhaled by the wearer, the at least one airflow intake capable of directing inward airflow to strike an interior air filter at an oblique angle;

(b) a head mounting pad having a single pull to tension the facemask against the wearer's face;

(c) a continuous strap positionable under the chin of the wearer;

(d) a nose bridge clip positionable by the wearer before and during the tensioning of the strap.

In the foregoing embodiment, the air filter is preferably replaceable and/or biocidal. The at least one vent is preferably a plurality of vents. The vent is preferably configured to direct exhaled air downwardly and backwardly towards the neck of the wearer. The nose bridge clip is preferably configurable to provide a compression zone over the wearer's nose. The compression zone preferably comprises portions of differing flexibility. The head mounting pad has an opening formed in an interior portion thereof, such that, for example, a wearer with hair in a ponytail can extend the ponytail through the opening and in a direction away from the wearer's head.

DETAILED DESCRIPTION OF PREFERRED EMBODIMENT(S)

As used herein "elastic" is intended to mean the state or quality of being elastic, flexible, resilient and/or adaptable.

As used herein "oblique" is intended to mean the state of being neither perpendicular nor parallel to a given line or surface; slanting; sloping.

As used herein "additive manufacturing" is intended to mean a process of making a three-dimensional solid object of virtually any shape from a digital model.

As used herein "diaphragm" is intended to mean a thin disk that vibrates when receiving or producing sound waves, as in a telephone, microphone, speaker or the like.

When describing elements of FIGS. 1-11, the same number is used to identify elements that are the same or substantially similar to each other in the different views illustrated in FIGS. 1-11.

Figure 1:
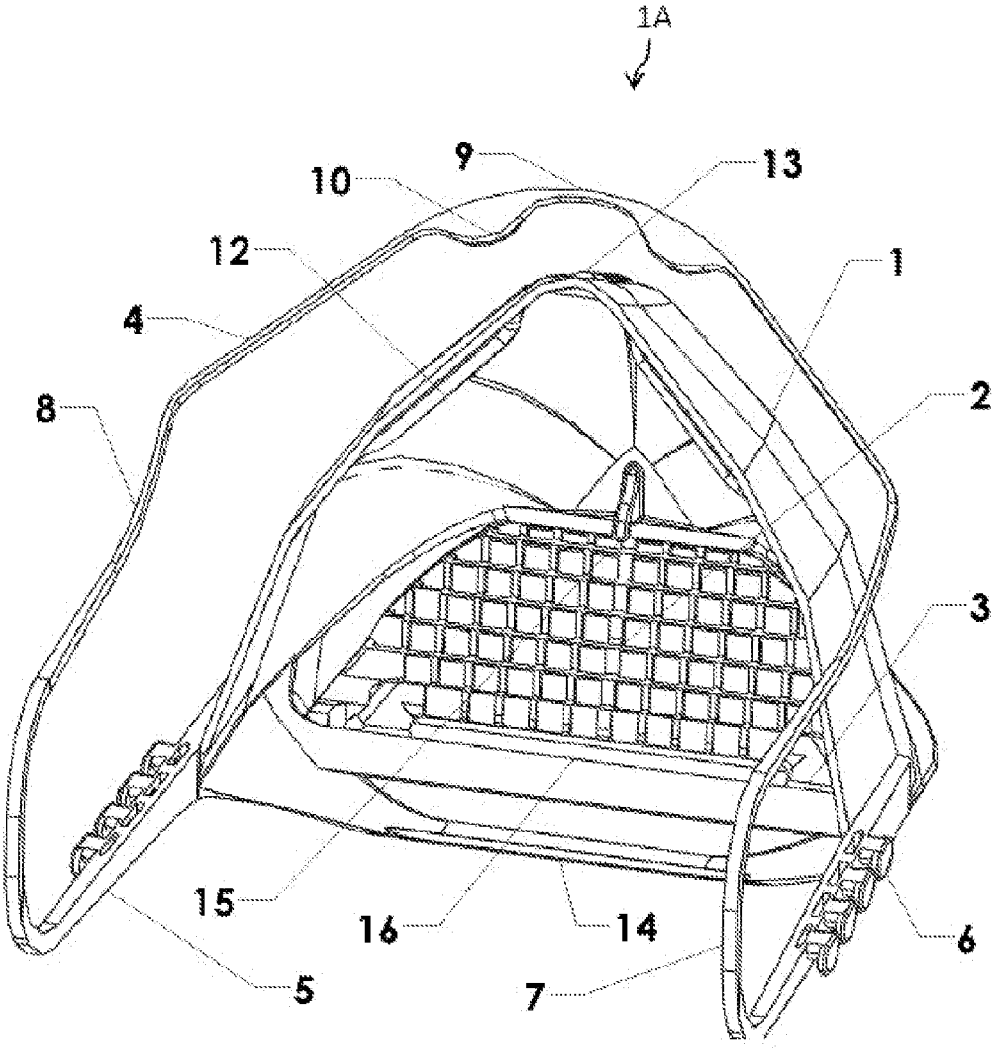
FIG. 1 is a perspective view taken from the back side of an embodiment of a facemask assembly with biocidal insert for protection against airborne pathogens.
Figure 2:
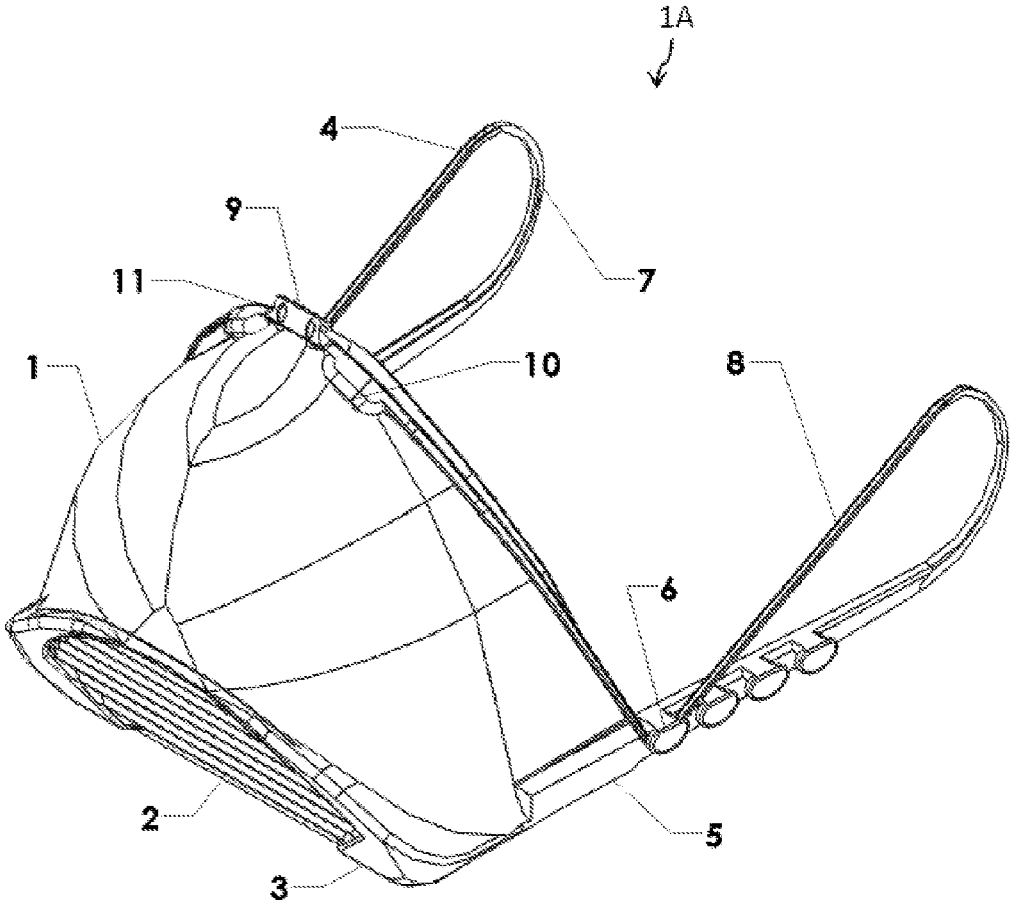
FIG. 2 is a perspective view taken from the front side of the facemask assembly illustrated in FIG. 1.

Turning first to FIGS. 1 and 2, illustrating facemask assembly 1A, elastic facemask 1 has a plurality of air channels 2 and side vents 3 formed therein for directing exhaled air flowing from the wearer's mouth down and back towards the neck of the wearer, and for directing inhaled air flowing into facemask 1 so as to strike a filter insert (not shown in FIGS. 1 and 2) at an oblique angle to enhance the capture and retention of airborne pathogens and particulates.

As shown in FIGS. 1 and 2, continuous strap 4 has a pair of lobes configured to press down against the wearer's nasal bone area. Strap 4 has more elastic section 8 designed to stretch downward to be inserted into the lobe extrusions 6 formed at the bottom of semi-rigid section 5. Strap 4 also includes a wider, rounded back-of-the-ear section 7 to provide greater comfort without stretching like common elastic rubber bands, which grab and pinch the skin.

As further shown in FIGS. 1 and 2, continuous strap 4 has nose bridge arch section 9 and a pair of lobes 10 designed to press down against the wearer's nasal bone area. A plurality of spaced extrusions 13 hold nose bridge arch section 9 to the wearer's preferred location on the nose bridge. A pair of hollow extrusions 12 form a secondary seal in the nasal bone area to inhibit the wearer's exhalations from escaping towards the eyes. Hollow extrusions 12 inflate with each exhalation to press facemask 1 against the wearer's face.

As shown specifically in FIG. 2, a pair of spaced holes 11 formed in nose bridge section 9 enable the ready insertion of an eye shield (illustrated in FIG. 10), which contains a pair of matching extrusions. The pull-down action atop the wearer's nose area simultaneously seals the nose section of facemask 1 to the wearer's face while securing the mask and leaning the mask against the wearer's forehead or eyeglasses. FIG. 2 also specifically illustrates semi-rigid section 5 of continuous strap 4, which enables elastic section 8 to be pulled down and secured to lobe extrusions 6.

FIGS. 1 and 2 also illustrate chin sealing section 14 of facemask 1, which can be extended backwards to enhance the seal to the wearer's face. Extrusion 15 captures and retains a filter insert (not shown) into facemask 1. Elastic groove 16 captures and seals the filter into the mask frame.

Figure 3:
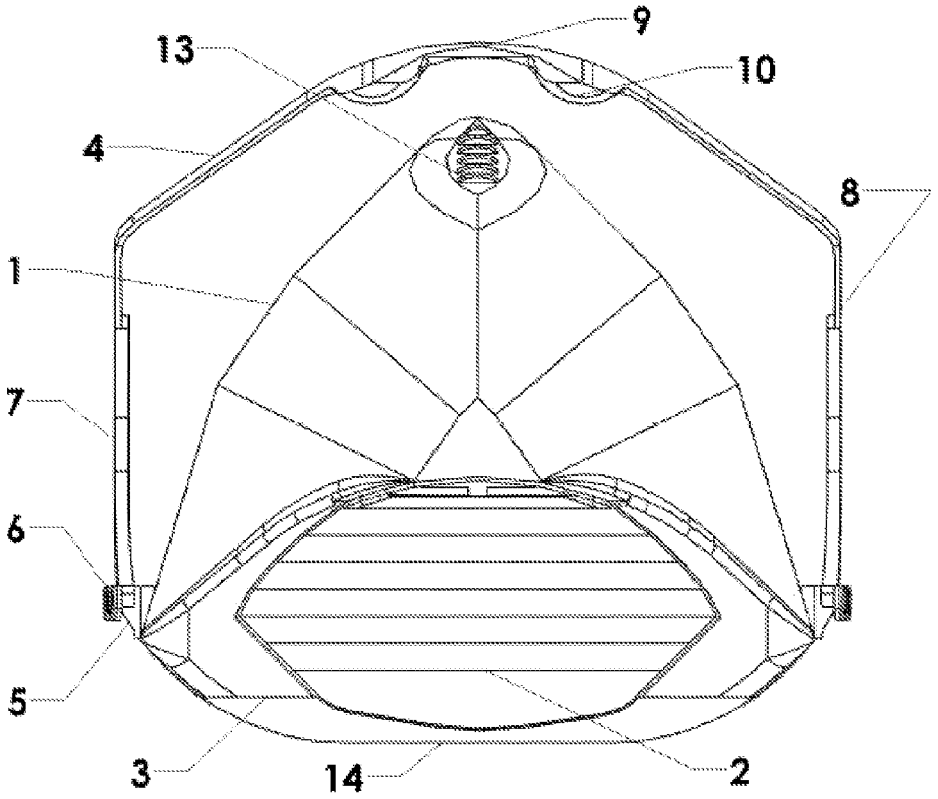
FIG. 3 is a front view of the facemask illustrated in FIGS. 1 and 2.

In FIG. 3, facemask assembly 1A is shown in a front view as including a facemask 1, a plurality of air channels 2 and side vents 3. Continuous strap 4 has a plurality of lobe extrusions 6 extending from semi-rigid section 5, as well as a back-of-the-ear section 7. A more elastic section 8 of continuous strap 4 stretches downward to be inserted into lobe extrusions 6 according to the amount of pressure the wearer wishes to have against the wearer's face.

FIG. 3 further illustrates continuous strap 4 as having nose bridge arch section 9 and a pair of lobes 10 designed to press down against the wearer's nasal bone area. A plurality of spaced extrusions 13 hold nose bridge arch section 9 to the wearer's preferred location on the nose bridge. Chin sealing section 14 of facemask 1 can be extended backwards to enhance the seal to the wearer's face.

Figure 4:
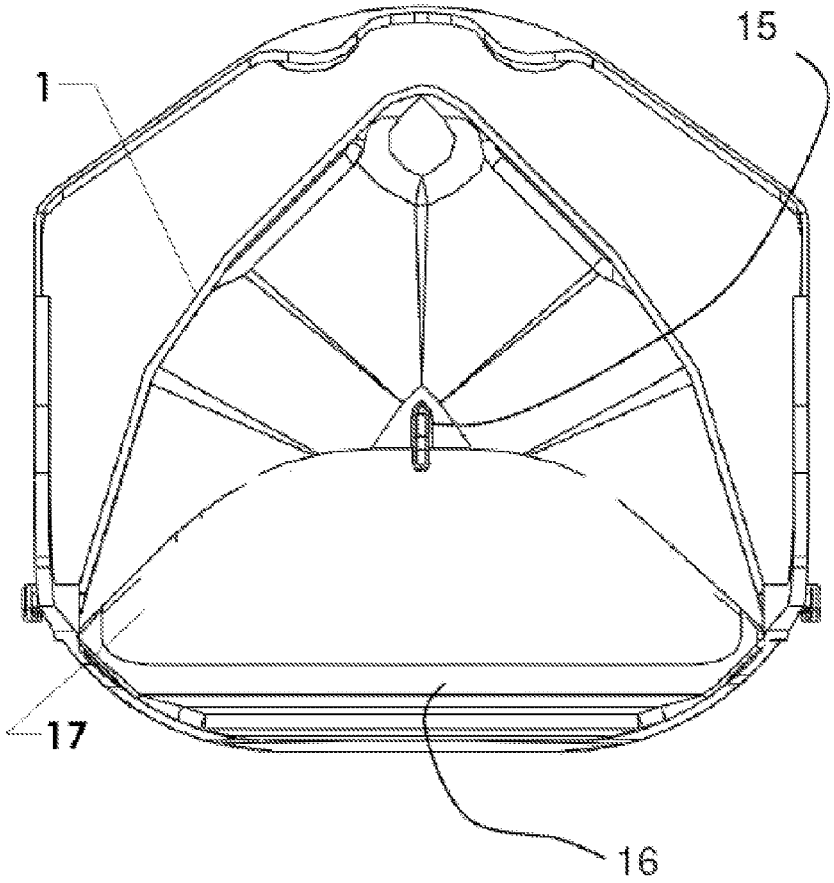
FIG. 4 is a back view of the facemask illustrated in FIGS. 1-3.

FIG. 4 specifically shows in a back view of facemask 1, in which extrusion 15 captures and retains a filter 17 in facemask 1. An elastic groove 16 captures and seals filter 17 within facemask 1.

Figure 5:
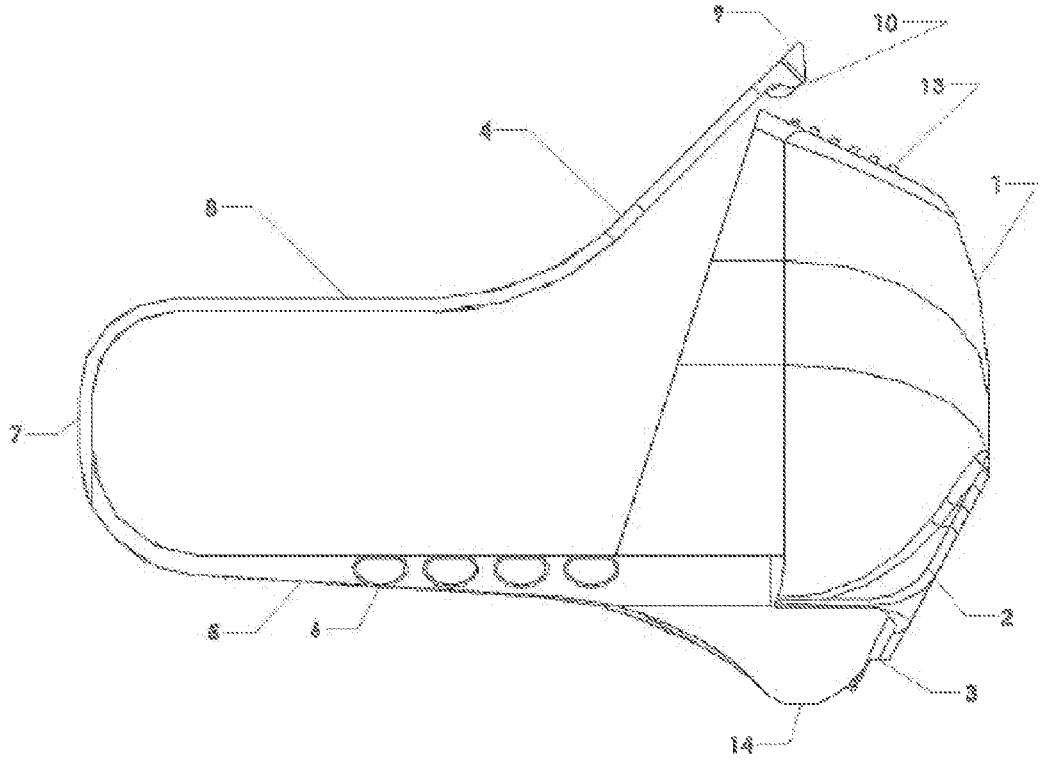
FIG. 5 is a side view of the facemask illustrated in FIGS. 1-4 with the strap unsecured.

FIG. 5 is a side view of facemask 1 with continuous strap 4 unsecured at its nose bridge arch section 9, which is insertable into one of a plurality of spaced extrusions 13 hold facemask 1 to the wearer's preferred location on the nose bridge.

Figure 6:
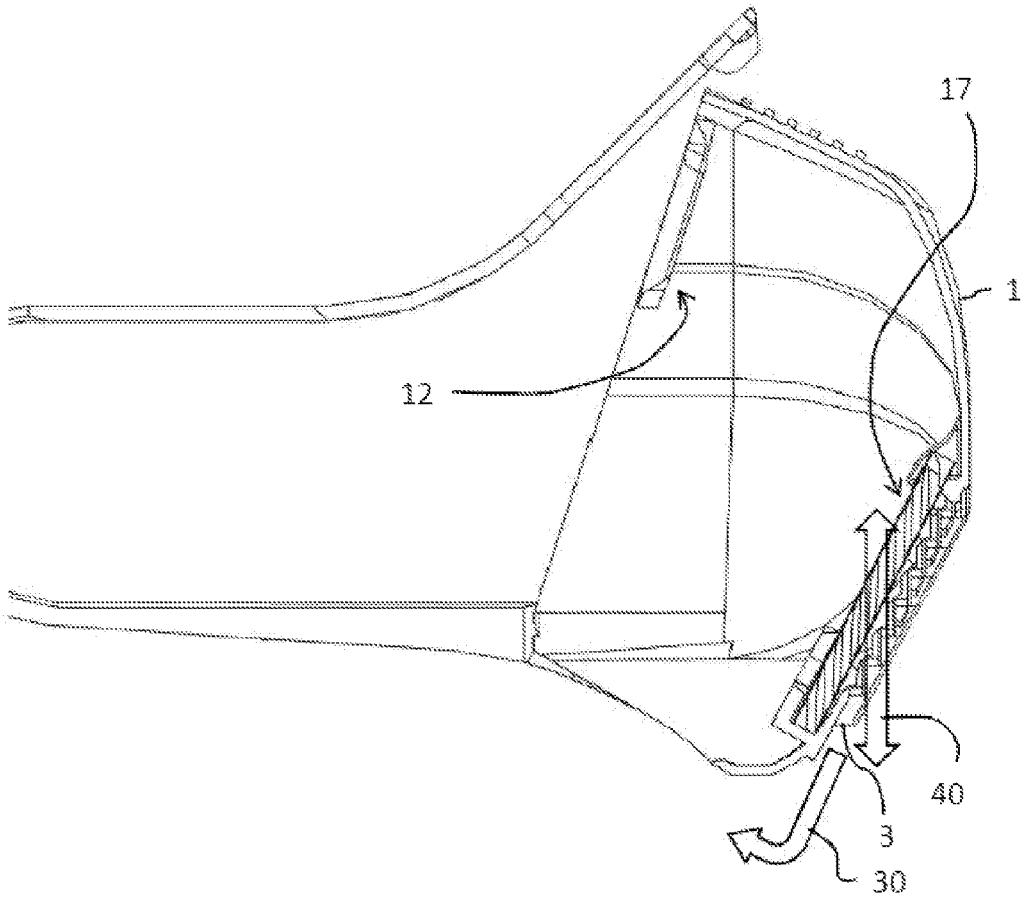
FIG. 6 is a side cutaway view of the facemask illustrated in FIGS. 1-5 with the filter inserted.

In the side cutaway view of FIG. 6, filter 17 is inserted into facemask 1. As depicted by arrow 40, bidirectional airflow induces entrained pathogens and particulates to strike filter 17 at an oblique angle. Arrow 30 depicts the channeling by side vents 3 of the wearer's exhalations down and backwards to further protect persons in front of the wearer.

As further shown in FIG. 6, a pair of hollow extrusions 12 form a secondary seal in the nasal bone area to inhibit the wearer's exhalations from escaping towards the eyes. Hollow extrusions 12 inflate with each exhalation to press facemask 1 against the wearer's face.

Figure 7:
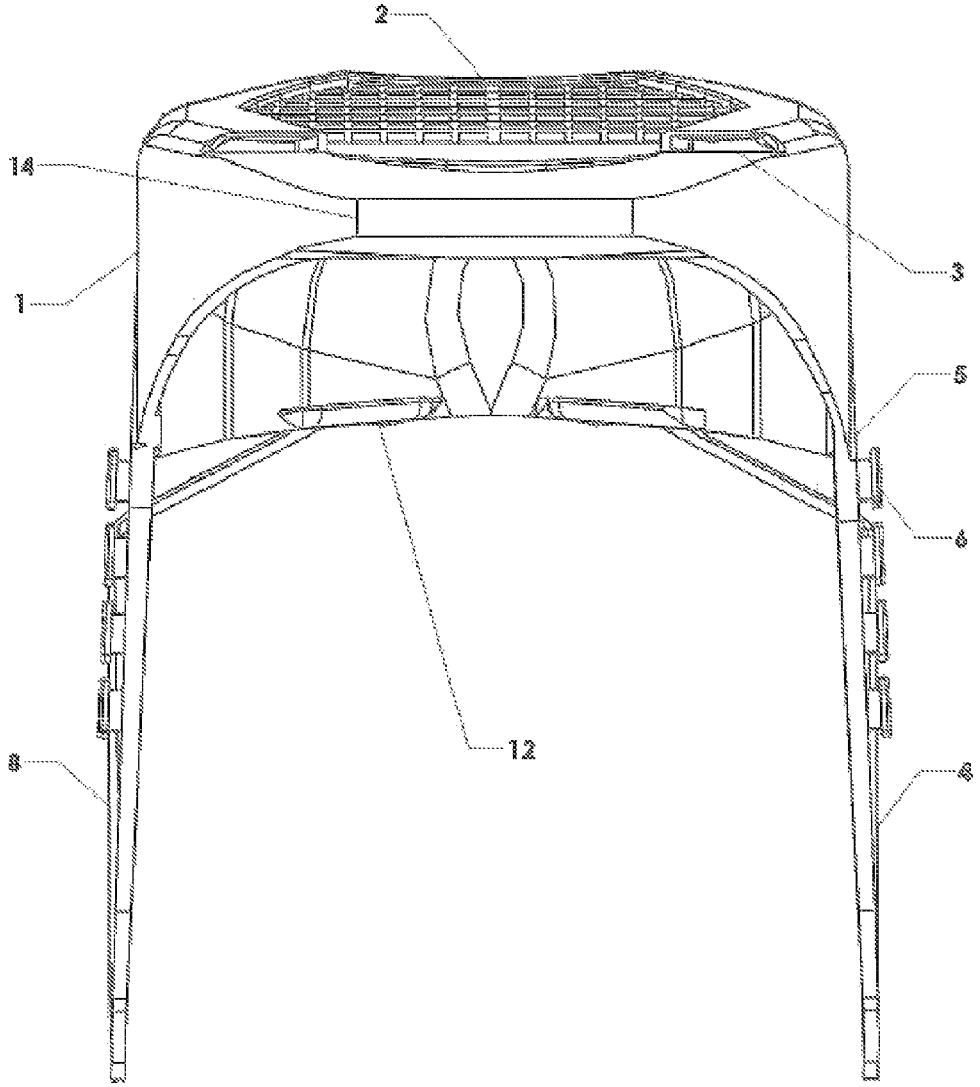
FIG. 7 is a bottom view of the facemask illustrated in FIGS. 1-6.

FIG. 7 specifically illustrates, in a bottom view, facemask 1 including lower front vents 2, with no front-facing openings. Side vents 3 direct the wearer's exhalations down and backwards. Hollowed extrusions 12 form a secondary seal in the nasal bone area to inhibit exhalations from being directed towards the wearer's eyes. Hollowed extrusions 12 inflate against the wearer's face with each exhalation.

Figure 8:
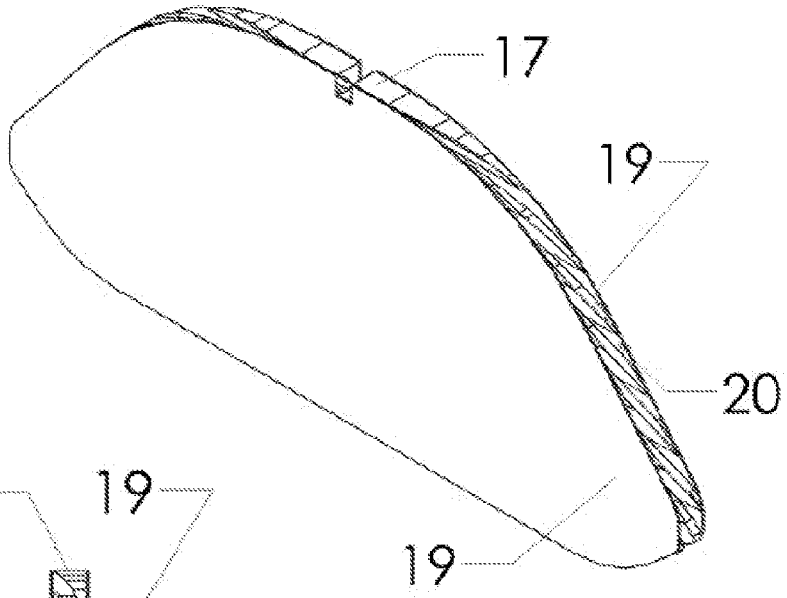
FIG. 8 is a perspective view of a filter insert for use in the facemask illustrated in FIGS. 1-7.
Figure 9:
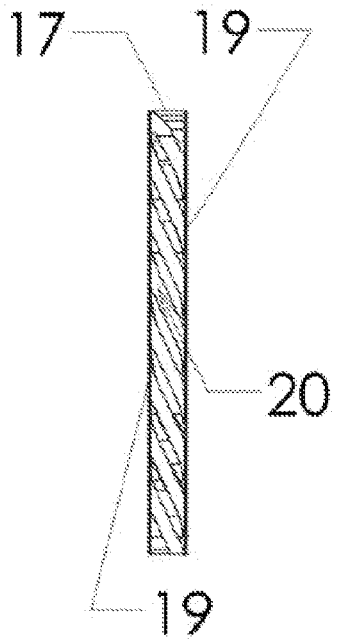
FIG. 9 is a side cross-sectional view of the filter insert illustrated in FIG. 8.

FIGS. 8 and 9 specifically illustrate filter insert 17, which has a frame containing a plurality of air channels 20 in approximate alignment with the air vents of the facemask to facilitate bidirectional air flow to strike the filter at an oblique angle. Filter material 19 can be varied depending upon the particular need of the wearer, such as antibacterial protection or capturing particulate matter. The S-shaped curved section of filter insert 17 increases the capture of airborne pathogens and particles.

Figure 10:
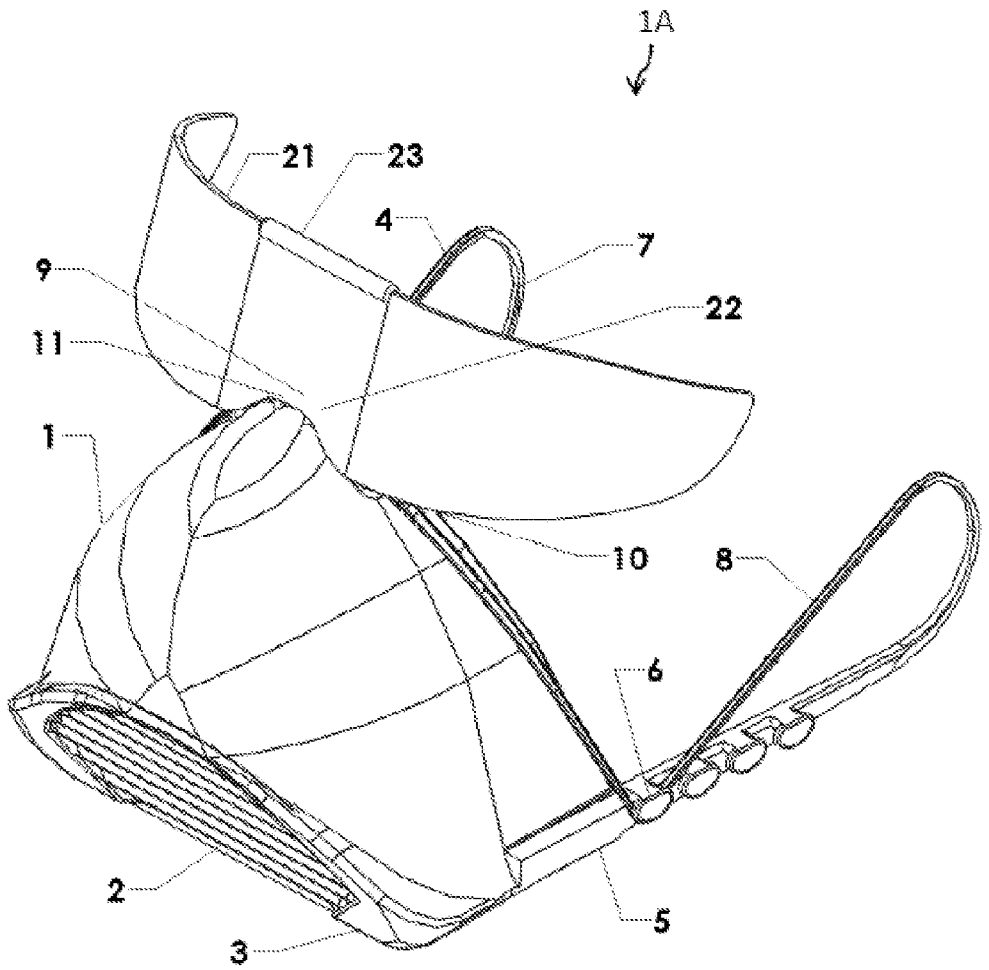
FIG. 10 is a perspective view of the front side of the facemask illustrated in FIGS. 1-6 with an eye shield attached.

FIG. 10 shows facemask 1 illustrated in FIGS. 1-6 with an exemplary eye shield 21 attached. Eye shield 21 has a pair of interior extrusions 22 that are insertable into a pair of spaced holes formed in nose bridge section 9 (see FIG. 2). Foam strip 23 allows eye shield 21 to rest comfortably against the wearer's forehead.

Figure 11:
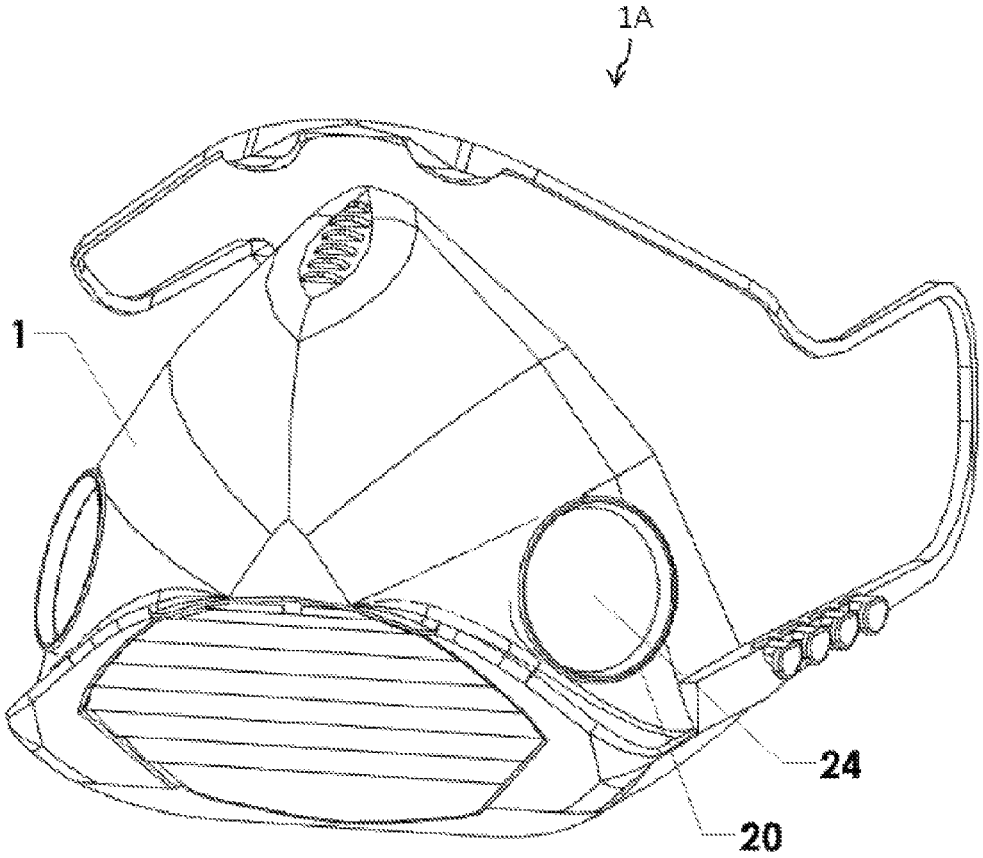
FIG. 11 is a perspective view of the front side of the facemask illustrated in FIGS. 1-6 with a pair of side resonators.

FIG. 11 shows facemask 1 with a pair of side resonators 24. Diaphragms within resonators 24 increase the volume and clarity of the wearer's speech. An elastic grooved flange 20 enables the insertion of the diaphragms.

The present facemask can be manufactured through additive manufacturing methodologies/materials which enable air channeling vents 2 and 3 illustrated in FIGS. 1 and 2 that direct the wearer's inhalation airflow to enter the mask at an oblique angle as well as exhalations to vent downward and backward towards the wearer's neck.

When describing elements of FIGS. 12-18, the same number is used to identify elements that are the same or substantially similar to each other in the different views illustrated in FIGS. 12-18.

Figure 12:
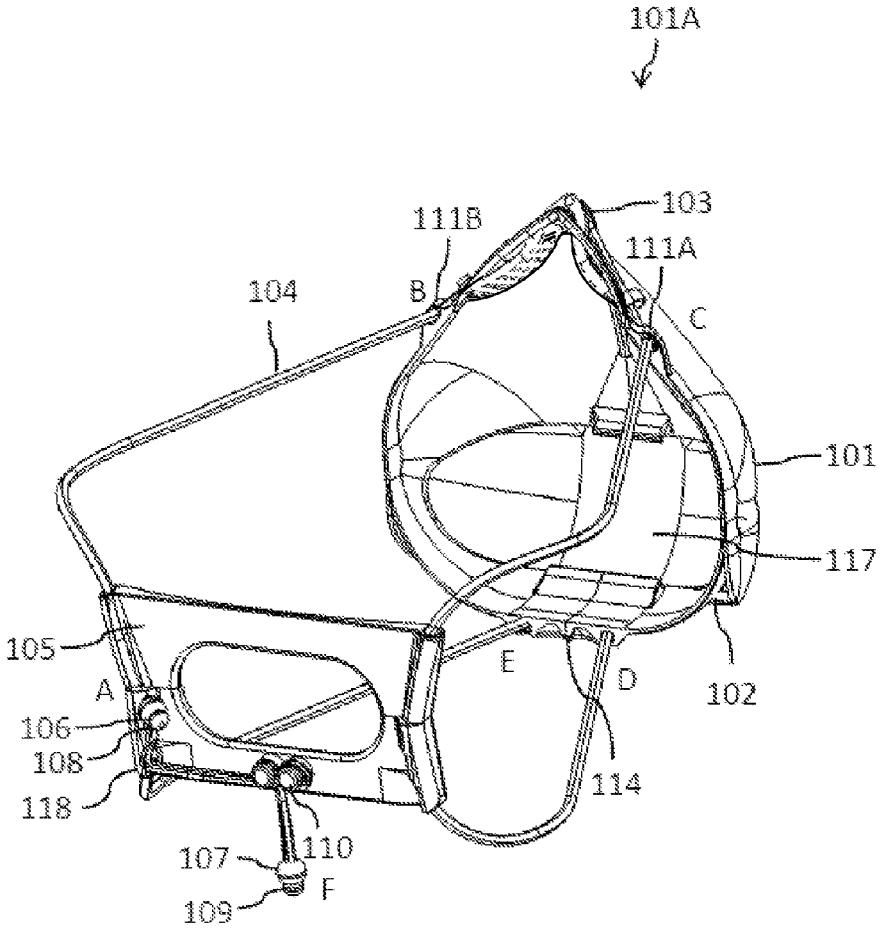
FIG. 12 is a perspective view taken from the back side of a second facemask assembly.

FIG. 12 is a perspective view taken from the back side of another embodiment of a facemask assembly 101A. Facemask assembly 101A comprises a facemask 101.

For some applications, facemask 101 can be configured to comprise a biocidal insert 117 for protection against airborne pathogens. Biocidal insert 117 can comprise one-sided or two-sided coverings of the central frame. For other applications, facemask 101 can be configured to comprise filter insert 117 suitable for protection only against particulates such as airborne dust.

Facemask 101 comprises one or more air vents such as air vent 102 of FIG. 12 for bidirectional flow of air being inhaled and exhaled by the wearer. Vent 102 is configured to direct inhaled air to strike the biocidal insert or filter insert 117 at an oblique angle to enhance the capture and retention of airborne pathogens and/or particulates. Vent 102 is configured to direct exhaled air down and back towards the neck of the wearer.

Figure 15A:
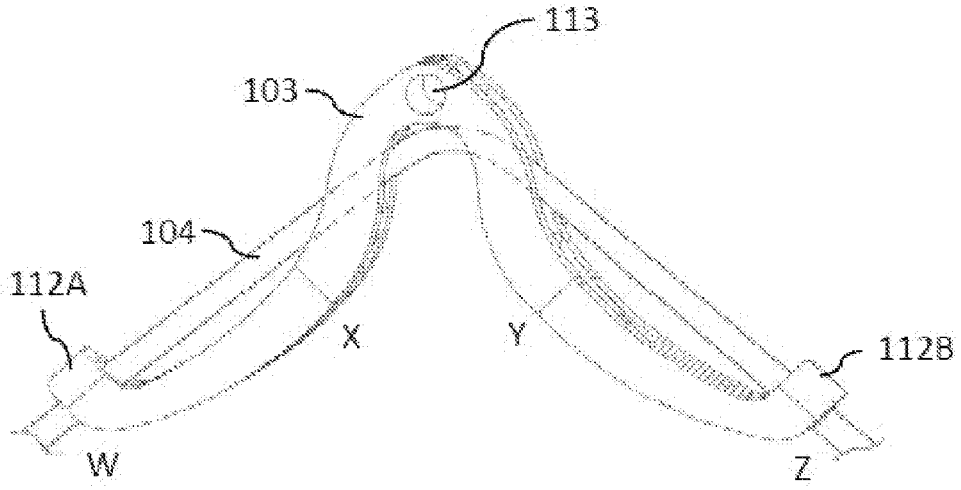
FIG. 15A is a detailed perspective view of the nose bridge clip of the facemask illustrated in FIGS. 12-14.
Figure 15B:
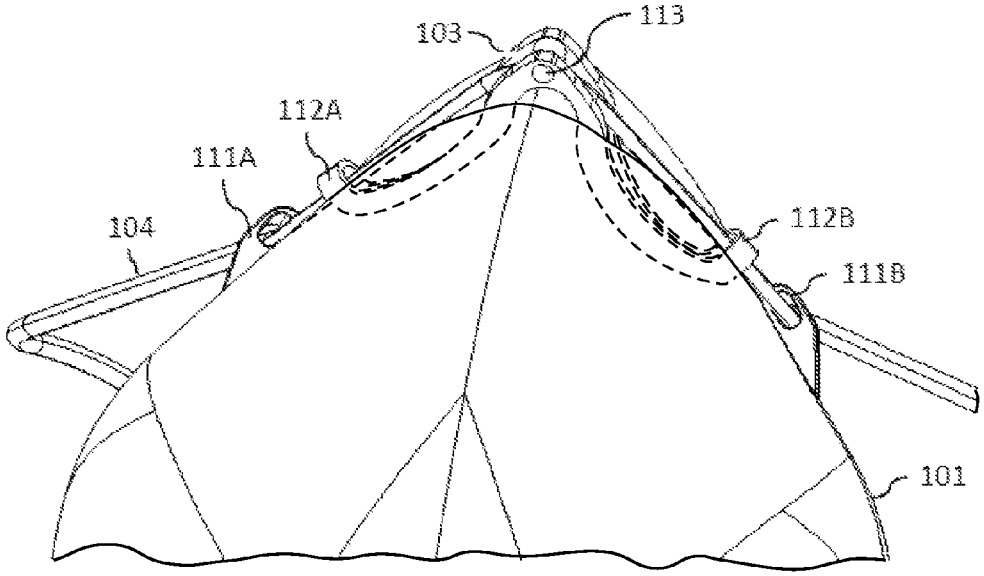
FIG. 15B is a perspective view of a section of the facemask illustrated in FIGS. 12-14 showing detail of the nose bridge clip.

Facemask 101 further comprises a nose bridge clip 103 described in more detail in reference to FIGS. 15A and 15B.

Facemask 101 further comprises a continuous strap 104. Continuous strap 104 comprises five contiguous sections labeled AB, BC, CD, DE and EF in FIG. 12. Section AB of continuous strap 104 runs from the start of strap 104, up through the interior of the left side of the head mount pad 105, then forward through a through-hole 111B and into the left side of nose bridge clip 103. (Left and right sides are defined from the wearer's perspective.) Section BC of continuous strap 104 spans nose bridge clip 103 of facemask 101, running from the left side of nose bridge clip 103 to the right side. Section CD of continuous strap 104 runs from the right side of nose bridge clip 103 via a through-hole 111A to the right side of the head mount pad 105. Strap 104 then travels down through the interior of the right side of head mount pad 105, and out through the bottom, and from there forward to chin strap structure 114. Section DE of continuous strap 104 spans chin strap structure 114, running from the right side to the left side. Section EF of strap 104 runs from the left side of chip strap structure 114 via a side hole 118 located at the bottom of head mount pad 105 to the end of strap 104 at stopper knot 109.

Figure 13:
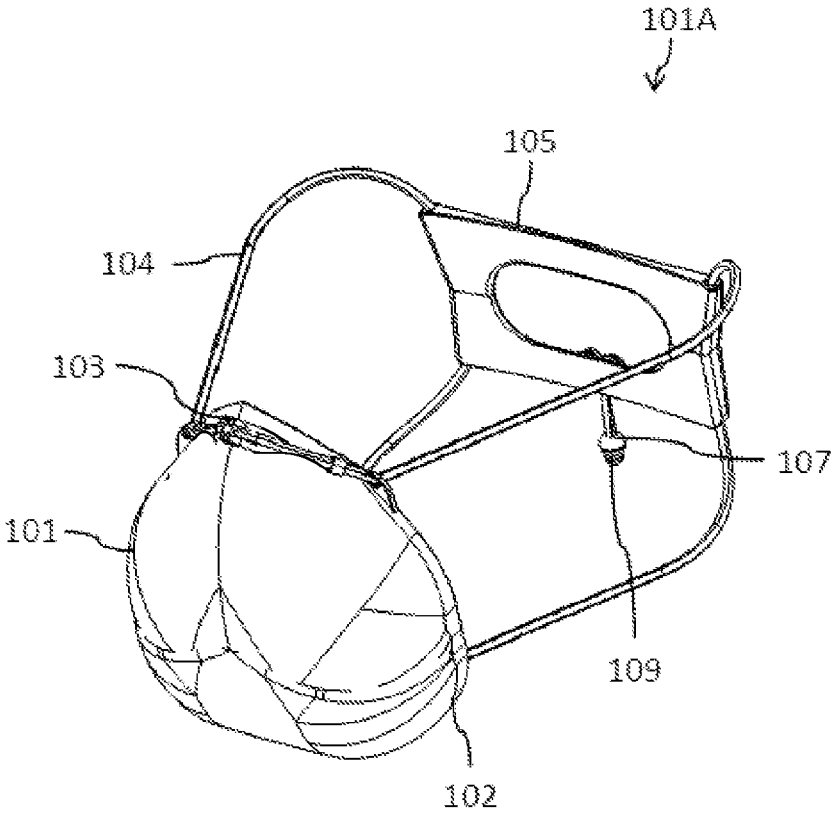
FIG. 13 is a perspective view taken from the front side of the facemask assembly illustrated in FIG. 12.

FIG. 13 is a perspective view taken from the front side of facemask assembly 101A illustrated in FIG. 12. As described above, facemask assembly 101A comprises facemask 101, vent 102, nose bridge clip 103, continuous strap 104 and head mount pad 105. The elements of facemask assembly 101A are described in more detail below in reference to FIGS. 14-18.

Figure 14A:
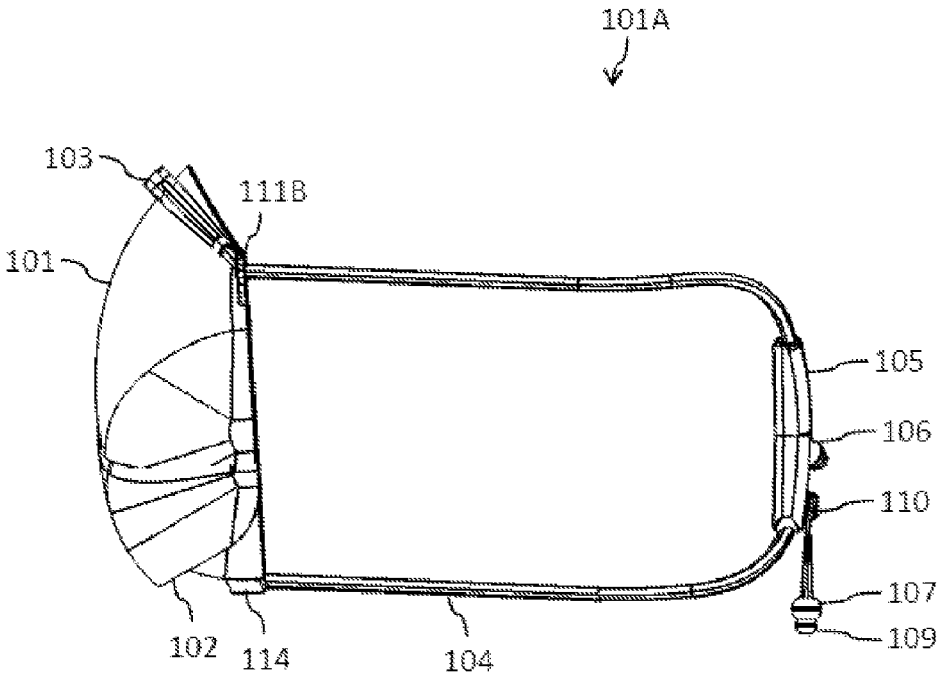
FIG. 14A is a side view of the facemask assembly illustrated in FIGS. 12 and 13.

FIG. 14A is a side view of facemask 101 illustrated in FIGS. 12 and 13. Facemask 101 comprises vent 102, nose bridge clip 103, continuous strap 104, head mount pad 105, beads 106 and 107, stopper knots 108 (not shown in FIG. 14) and 109, and one or more extrusions 110.

A part of continuous strap 104 runs from the base of nose bridge clip 103 to the top of head mount pad 105. Another part of continuous strap 104 runs from a chin strap structure 114 (described in detail in reference to FIG. 16) to the bottom of head mount pad 105.

When strap 104 is in tension, facemask 101 is held fast against the face of the wearer, and head mount pad is held fast against the back of the head of the wearer.

Figure 14B:
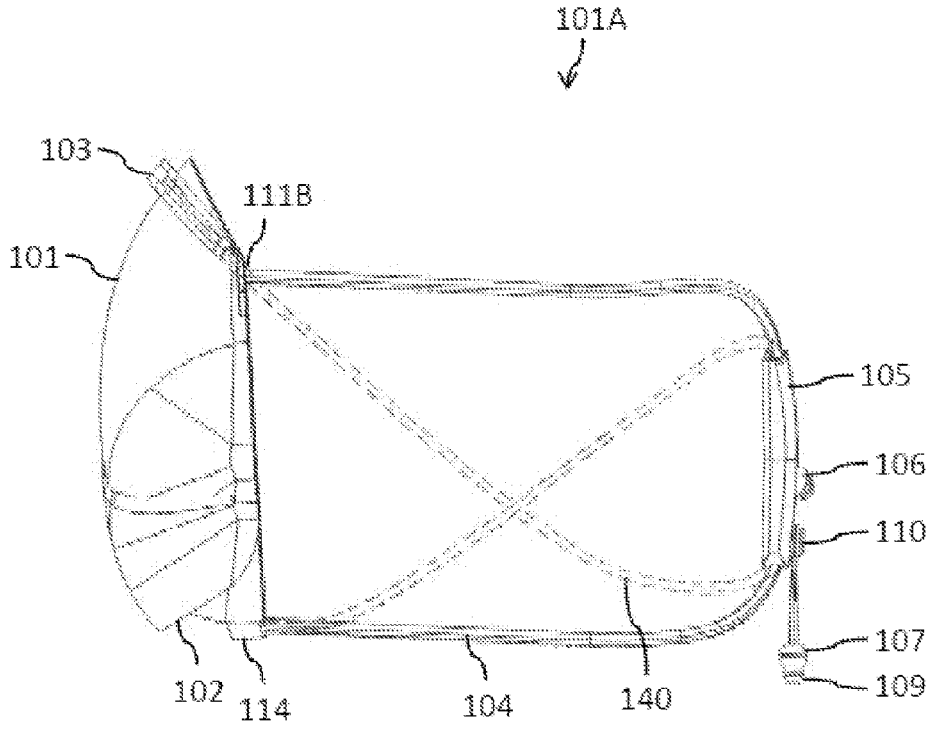
FIG. 14B is a side view of the facemask assembly illustrated in FIGS. 12 and 13 with alternative cross-strapping indicated by dashed lines.

FIG. 14B is a side view of facemask 101 illustrated in FIGS. 12-14A with alternative cross-strapping 140 indicated by dashed lines. Cross-strapping 140 comprises continuous strap 104 of FIG. 14A rerouted between nose bridge clip 103, chin strap structure 114 and head mount pad 105 as described below.

A part of cross-strapping 140 runs from the base of nose bridge clip 103 to the bottom of head mount pad 105. Another part of cross-strapping 140 runs from a chin strap structure 114 (described in detail in reference to FIG. 16) to the top of head mount pad 105.

When cross-strapping 140 is in tension, facemask 101 is held fast against the face of the wearer, and head mount pad is held fast against the back of the head of the wearer. Re-routing continuous strap 104 in the manner described above results in a greater downward tension on the top of facemask 101 and a concomitant greater upward tension on the bottom of facemask 101, which can improve the seal of facemask 101 to the face of the wearer.

Through-holes 111A (not shown in FIG. 14B) and 111B can be configured to direct strap 104 at an approximately 45° angle below the horizontal. Through-holes 111A and 111B are further illustrated in FIG. 15B.

FIG. 15A is a detailed perspective view of nose bridge clip 103 of facemask 101 illustrated in FIGS. 12-14. Nose bridge clip 103 can be configured to provide a compression zone over the nose of the wearer, the compression zone comprising one or more sections of different flexibility. In the embodiment illustrated in FIG. 15A, nose bridge clip 103 comprises three sections labeled WX, XY and YZ providing two different types of flex.

Middle section XY can be manufactured from a suitable semi-rigid flexible material. In operation, the wearer positions section XY atop facemask 101 and over the nasal bone area of the wearer's nose.

Sections WX and YZ can be manufactured from softer, more flexible material than section XY. In operation, sections WX and YZ are generally over the soft tissue area of the upper cheeks of the wearer's face.

Nose bridge clip 103 further comprises eyelets 112A and 112B, and mounting hole 113. Mounting hole 113 can be used to attach an accessory, for example a face shield or an eye shield.

Continuous strap 104 is threaded through nose bridge clip 103 and eyelets 112A and 112B as illustrated in FIG. 15A. When strap 104 is tensioned, it pulls the middle section XY of nose bridge clip 103 against the nasal bone area and the outer sections WX and YZ against the upper cheeks of the wearer's face, thereby creating an effective seal.

It is a benefit of the present facemask assembly that nose bridge clip 103 can be positioned by the wearer before and during the tensioning of strap 104. An advantage of being able to position nose bridge clip 103, and of facemask assembly 101A being more adjustable, is an increased likelihood that facemask assembly 101A is more comfortable and effective than conventional facemask assemblies. Furthermore, nose bridge clip 103 can be manufactured to suit the facial physiology of the wearer. In practice, facemask assembly 101A can be supplied with one or more nose bridge clips and the wearer can select the most suitable nose bridge clip for the wearer's physiology.

FIG. 15B is a perspective view of a portion of facemask 101 illustrated in FIGS. 12-14 showing detail of nose bridge clip 103. Strap 104 is threaded through nose bridge clip 103, eyelets 112A and 112B, and through-holes 111A and 111B. Strap 104 runs from through-holes 111A and 111B to the right and left sides respectively of head mount pad 105 (not shown in FIG. 15B).

Figure 16:
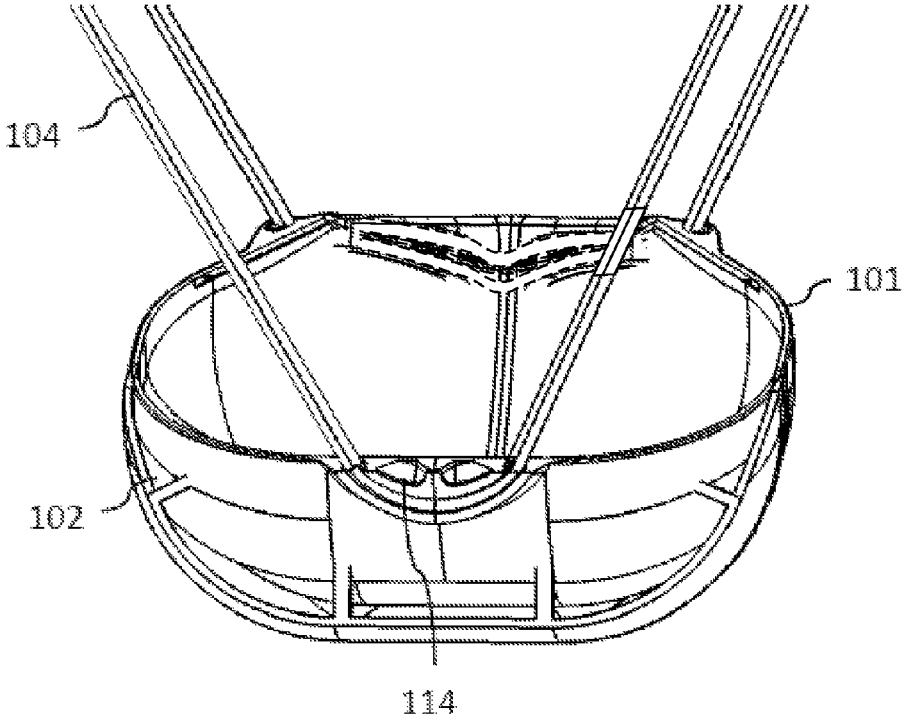
FIG. 16 is a detailed perspective view taken from the underside of the facemask illustrated in FIGS. 12-15.

FIG. 16 is a detailed perspective view taken from the underside of facemask 101 illustrated in FIGS. 12-15. Facemask 101 comprises air vent 102. Inhaled air is directed up into facemask 101 by vent 102, the inhaled air striking an interior filter 117 (not shown in FIG. 16) at an oblique angle. Exhaled air is directed out of facemask 101 by vent 102, the exhaled air being directed down and back towards the neck of the wearer.

Facemask 101 further comprises a chin strap structure 114. In some embodiments, chin strap structure 114 can be a tab or another suitable feature into which continuous strap 104 can be clipped. In other embodiments, chin strap structure 114 can be a hole through which continuous strap 104 can be threaded.

It is a benefit of the present embodiment that chin strap structure 114 (in which strap 104 passes under the jaw) can provide an improved seal of facemask 101 to the face of the wearer relative to other embodiments or facemasks in which the strap is at, or above, the jawline.

Continuous strap 104 as illustrated in FIGS. 12-16 can be hollow medical-grade surgical tubing. Other suitable material can be used, for example O-ring cord or cordage.

Figure 17:
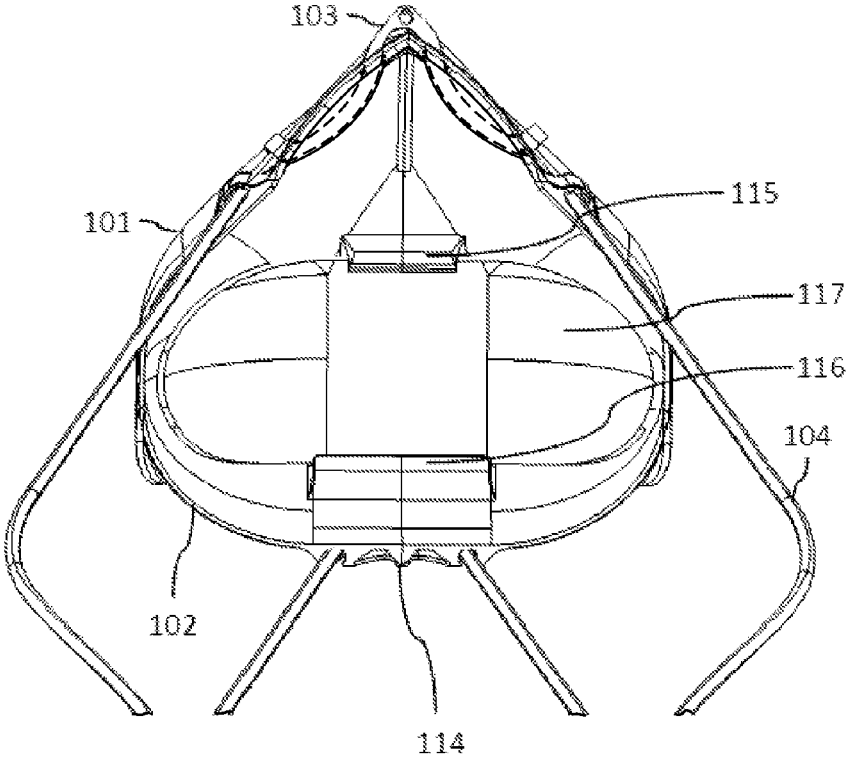
FIG. 17 is a back view of the facemask illustrated in FIGS. 12-16.

FIG. 17 is a back view of facemask 101 illustrated in FIGS. 12-16. Facemask 101 comprises an interior filter 117.

Filter insert 117 comprises a filter frame. One or both major sides of the filter frame can be covered with biocide material to destroy pathogenic particles. Alternatively the filter frame can be configured to simply provide protection from non-pathogenic particulates such as dust.

The filter insert can be held in place by tabs 115 and 116 at the top and bottom respectively of the filter insert. Alternatively, the filter insert can be held in place by tabs on the left and right-hand sides, or by another suitable mechanism.

Filter 117 insert can be concave in shape to fit facemask 101, for example, or it can be flat as in facemask assembly 1A described above.

FIG. 17 illustrates the inward thrust of nose bridge clip 103, the clip being described in more detail above in reference to FIGS. 15A and 15B.

Figure 18:
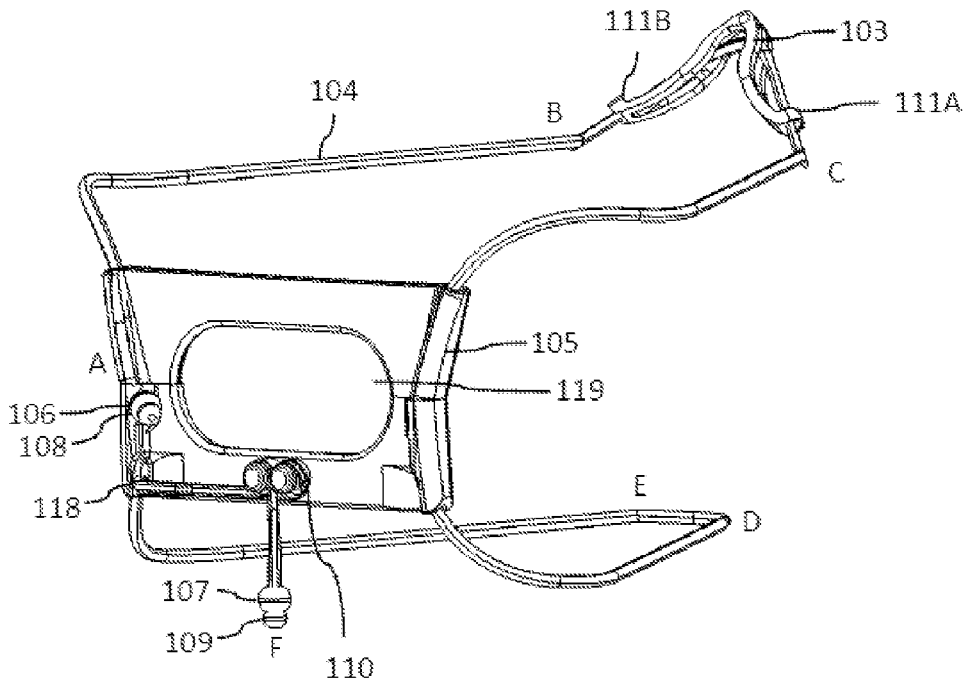
FIG. 18 is a detailed perspective view of the nose clip, continuous strap and head mount pad of the facemask assembly illustrated in FIGS. 12 and 13 taken from the back side of the facemask assembly.

FIG. 18 is a detailed perspective view of nose clip 103, continuous strap 104 and head mount pad 105 of facemask assembly 101A illustrated in FIGS. 12 and 13 taken from the back side of facemask assembly 101A.

Starting at position A in FIG. 18, strap 104 is threaded through bead 106, and stopper knot 108 is used to prevent the end of strap 104 from pulling through bead 106. Strap 104 runs upward through an interior channel of head mount pad 105 and then to position B where it passes through through-hole 111B on facemask 101 (not shown in FIG. 18). Strap 104 passes to position C via nose bridge clip 103 and through-hole 111A. From position C, strap 104 runs via head mount pad 105 to position D on the right side of chin strap structure 114 (not shown in FIG. 18). Strap 104 then passes through chin strap structure 114 to position E, and from there back to head mount pad 105. Strap 104 passes through side hole 118 (which, in this example, is on the left hand side) and out through the back side of head mount pad 105.

At head mount assembly pad 105, strap 104 loops around one or more extrusions 110, for example using a figure of eight. Strap 104 is pulled down from extrusions 110 to securely fasten it. Alternatively, another suitable mechanism (including but not limited to a grip or a clip) can be used to secure the strap at the back of head mount pad 105.

The end of strap 104 is threaded through bead 107, and stopper knot 109 is used to prevent strap 104 from pulling back through bead 107.

While facemask assembly 101A as illustrated in FIGS. 12-18 has starting position A on the left side of the assembly (when viewed from the back or from the perspective of the wearer), it will be understood that in other embodiments (such as for a left-handed wearer) the starting position A can be on the right side of the assembly.

In operation, the wearer can adjust facemask assembly 101A as follows. Such adjustment can be done, for example, the first time the wearer dons the facemask assembly.

First, head mount pad 105 is placed against the back of the head. Secondly, the facemask is placed over the face. Next, the nose bridge clip is positioned over the wearer's nose, and sections AB, BC and CD of strap 104 are tensioned using the right hand to pull section CD through the nose clip and to hold the nose bridge clip fast against the nose. Sections DE and EF of strap 104 are tensioned, this time using the left hand, and by holding the head mount pad in position with the right hand. Once the tension is as desired, strap 104 is looped around extrusions 110 and pulled down to fasten it.

Once adjusted as described above, the facemask assembly can be readily removed by the wearer, for example, by holding the facemask and lifting the head mount pad forward over the head.

Since strap 104 is securely fastened, removing the facemask assembly will not significantly affect the tensioning of the strap. The wearer can don the facemask assembly again, without further adjustment, by placing the mask on the face, positioning the nose bridge clip, and then pulling the head mount pad back over the head.

Head mount pad 105 comprises an opening 119 which can accommodate a pony tail or hair bun.

It is a benefit of the present invention that the interior air filter (or filter insert) is in close proximity to the nose and mouth of the wearer, thereby providing less opportunity for backflow, build-up of $CO_2$ within the facemask, and/or re-inhalation of exhaled air by the wearer.

Figure 19:
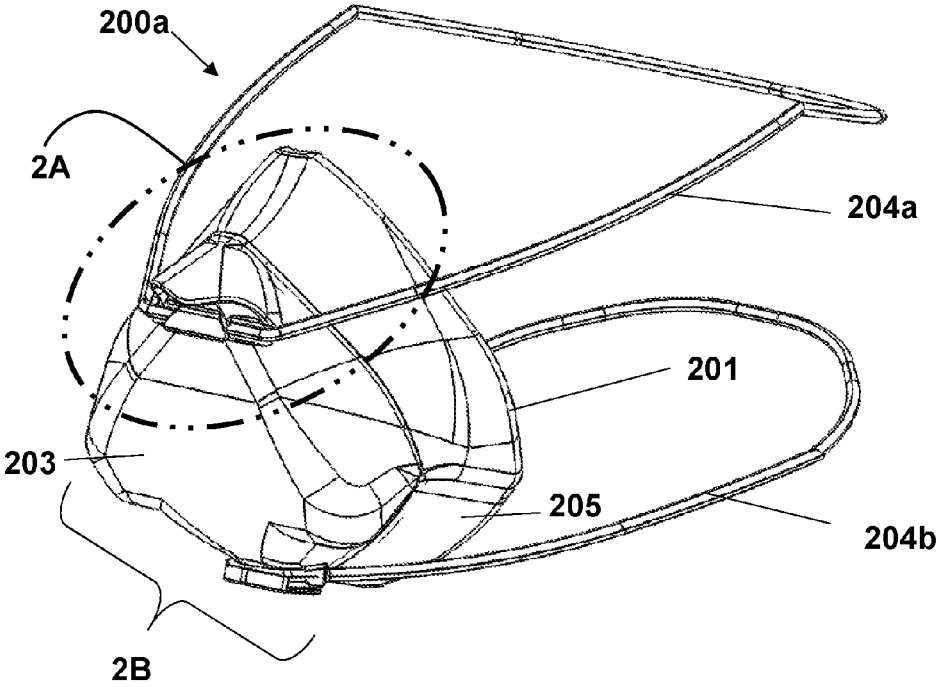
FIG. 19 is a perspective view taken from the front side of a third facemask assembly.
Figure 19A:
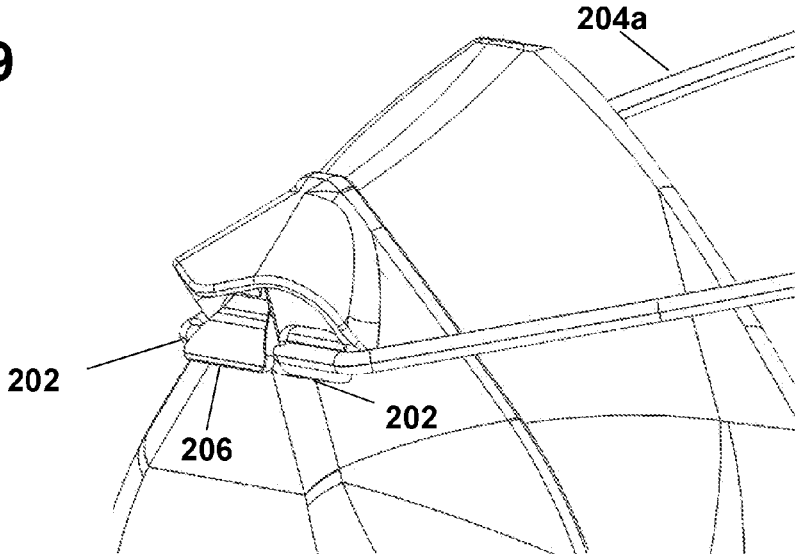
FIG. 19A is a close up perspective view of the nasal area indicated by section 2A in FIG. 19.
Figure 19B:
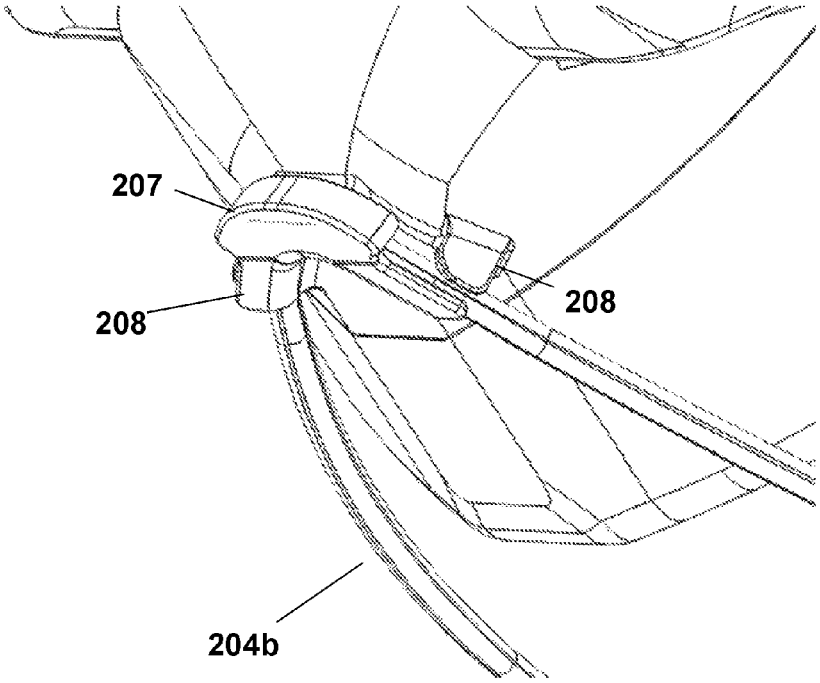
FIG. 19B is a close up perspective view of the chin area indicated by section 2B in FIG. 19.

Turning to FIGS. 19, 19A and 19B illustrate another embodiment of a facemask assembly. Facemask assembly 200*a* includes elastic facemask section 201. Facemask section 203 has nasal area 2A (shown in detail in FIG. 19A) and chin area 2B (shown in detail in FIG. 19B). Front section 203 can be made of a hard plastic, among other materials. In some embodiments front section 203 is made of a thin plastic material that improves the speech clarity of the user by resonating. Face mask section 201 can be made of a soft silicone that is comfortable to wear. In some embodiments face mask section 201 creates an airtight seal with a user's face.

Nasal area 2A and chin area 2B have snap-in constructs 202 and 207 configured to enable the snapping in of various straps, cords, tubing, and/or O-ring stock. In FIG. 19 top strap 204*a* and bottom strap 204*b* are used to keep facemask assembly 200*a* properly positioned on the users head.

Snap-in constructs 202 and 207 allow straps 204*a* and 204*b* to be inserted, removed and replaced. Snap-in constructs 202 and 207 also enable a wearer to make emergency repairs to facemask assembly 200*a*. For example, if top strap 204*a* were to break and the user did not have access to a proper replacement strap, the user could utilize a wide variety of suitable materials such as his or her own shoelace for an immediate field repair. This feature could be life-saving should such an immediate field repair be necessary in an infectious or hazardous air environment.

In some embodiments top strap 204*a* can slide upward to enter into void 206 which allows top strap 204*a* to slide back and forth to balance the position of any clips and/or buckles (not shown). In some embodiments the combination of snap-in constructs 202 and void 206 allows for top strap 204*a* to be easily removed and/or replaced.

Turning to chin area 2B in FIG. 19B, snap-in construct 207 and optional side clips 208 help maintain bottom strap 204*b* in place.

Figure 20:
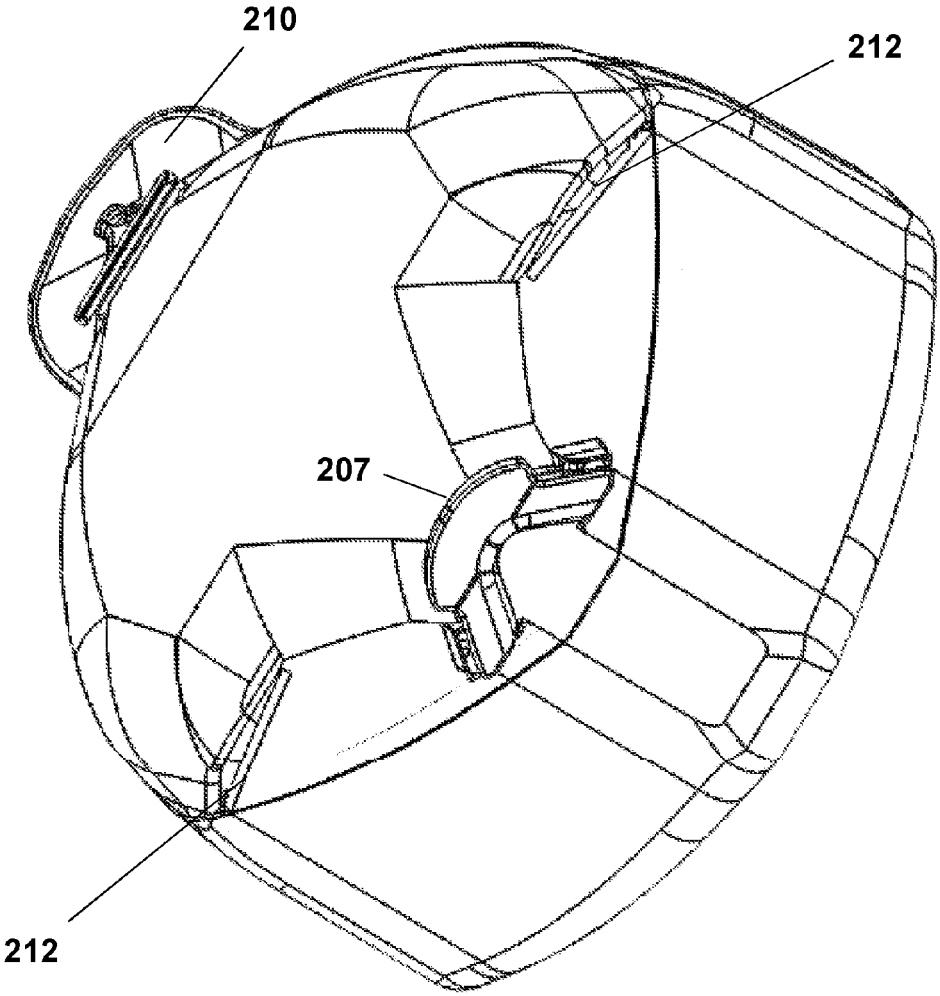
FIG. 20 is a bottom view of the facemask assembly of FIG. 19.

FIG. 20 illustrates a bottom view of facemask assembly 200*a*. Nasal vent 210 allows the escape of exhaled heat and $CO_2$ loaded air which leads to improved speech clarity and improved nasal or nose breathability. Nasal vent 210, coupled with the greater porosity of filter material 226 (see FIG. 22B) on the internal filter due to the oblique airflow supports improved nose breathability. The oblique angle air flow supports greater capture of air-borne elements within surface filter material 226 (see FIG. 22B). In addition, nasal breathing has been found to lower blood pressure and individuals' heartrates. It has also been found to help improve the function of individual's organs, including the brain, with optimal oxygenation.

Lower side vents 212 aid in sending exhaled air backwards and away from those in front of the user. The user may be ill and therefore it is important to keep his or her exhalations away from those he or she is interacting with. Lower side vents 212, like nasal vent 210, aid in preventing (or at least reducing) direct frontal contact of particles onto filter material 226 (see FIG. 22B).

Figure 21:
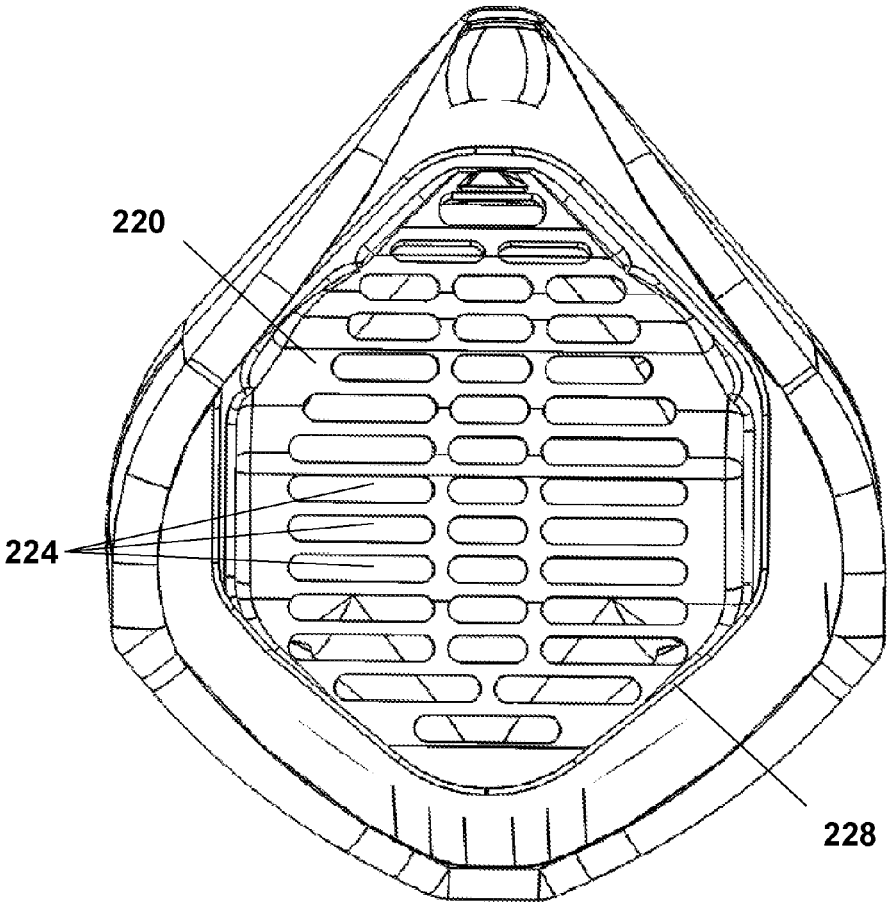
FIG. 21 is a back view of the facemask assembly of FIG. 19 with a filter insert frame.
Figure 22A:
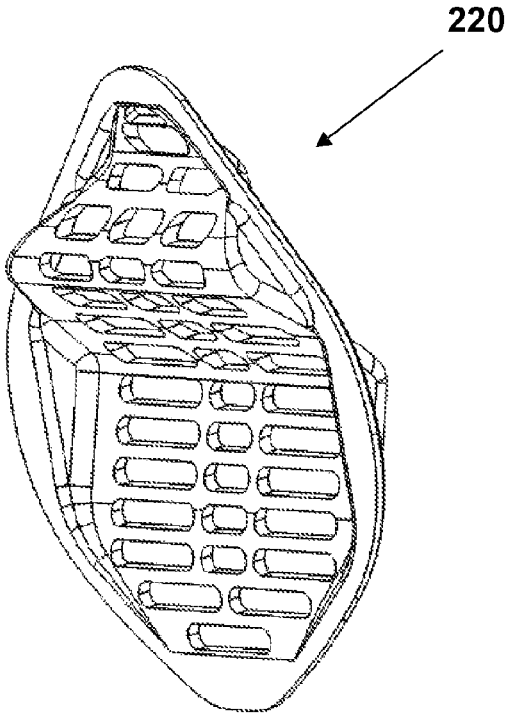
FIG. 22A is a perspective view of a curved filter insert frame.
Figure 22B:
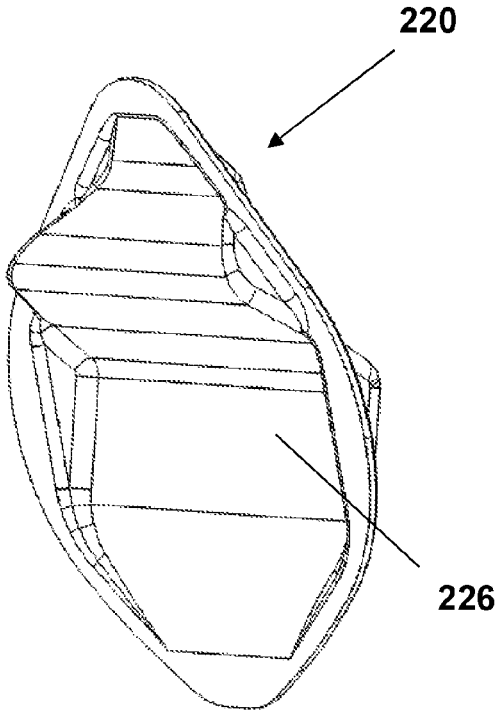
FIG. 22B is a perspective view of a curved filter insert frame with a filter material attached.

FIG. 21 shows a back view of facemask assembly 200*a* and a back view of curved filter insert frame 220 configured to receive filter material 226 (see FIG. 22B). Curved filter insert frame 220 includes breathing vents 224 (also present in FIG. 23). Elastic ridge 228 of facemask assembly 200*a* allows for the easy insertion and extraction of curved filter insert frame 220 against stopper ridge 230 (see FIG. 24). In some embodiments curved filter insert frame 220 with filter material 226 is disposable. In other embodiments curved filter insert frame 220 with filter material 226 can be cleaned and reused.

FIG. 22A and FIG. 22B are side perspective views of curved filter insert frame 220. FIG. 22A illustrates curved filter insert frame 220 without filter material 226 while FIG. 22B illustrates curved filter insert frame 220 with filter material 226. In some embodiments filter material 226 has a single active surface. In other embodiments filter material 226 can have multiple active surfaces. In certain embodiments the active material contains silver which acts as a biocidal element. In other or the same embodiments filter material 226 can be optimized for the capture of non-infectious particles such as dust or air pollution particulates. The "s-shaped" structure of curved filter insert frame 220 positions filter material 226 close to the nose and mouth. This is important when silver is used for biocidal protection as silver needs moisture to provide such protection.

Figure 23:
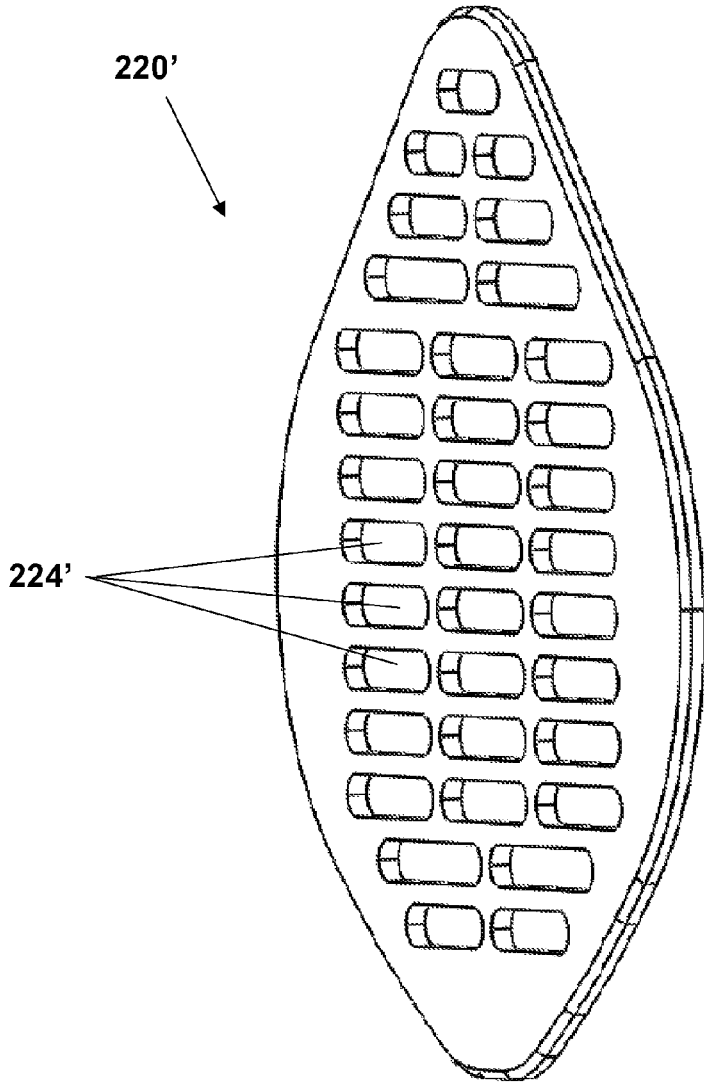
FIG. 23 is a perspective view of a flat filter insert frame.

FIG. 23 is perspective view a flat filter insert 220'. Curved filter insert frame 220 is configured to capture airborne particles and provide biocidal protection from airborne pathogens. Flat filter insert frame 220' is configured to capture particulate airborne particles. Its flat design allows for smaller packaging and cleaning for repeated use. Flat filter insert 220' includes breathing vents 224'. Filter material 226 can also be used with flat filter insert frame 220'.

Figure 24:
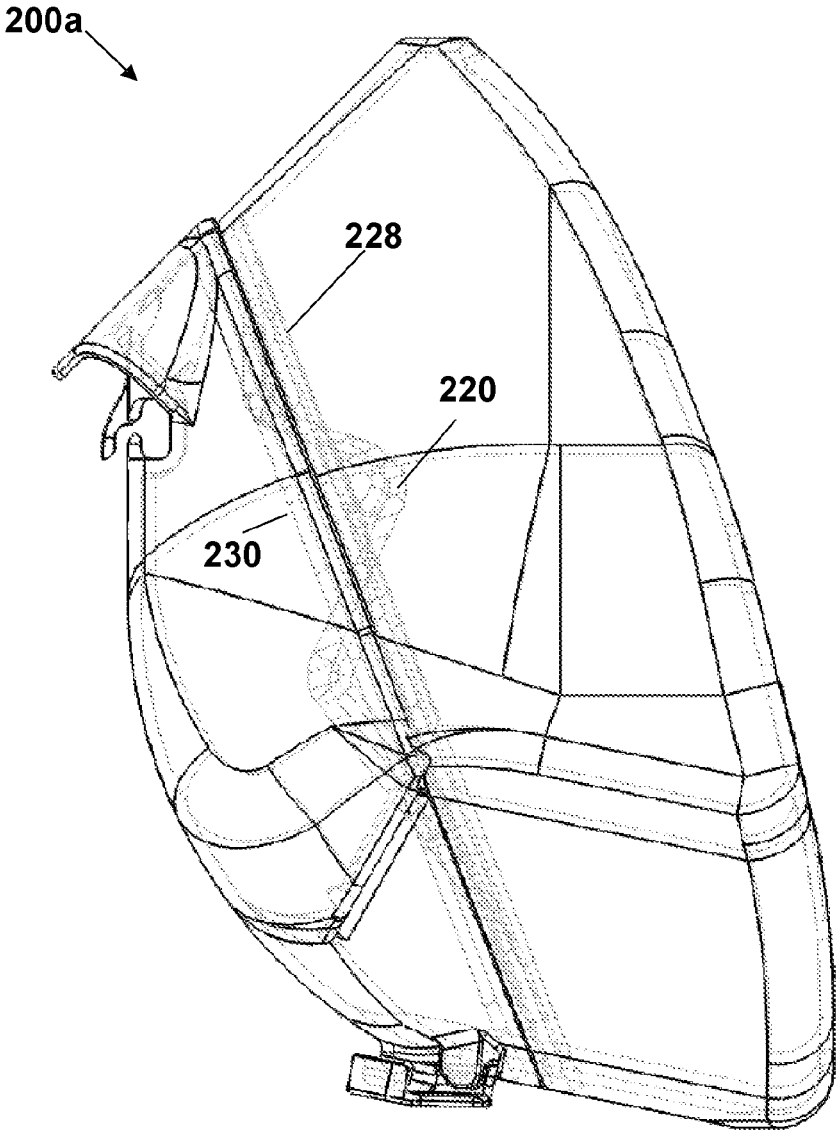
FIG. 24 is cutaway side view of the facemask assembly of FIG. 19 with a filer insert.

FIG. 24 is a side view of facemask assembly 200*a* with filter insert frame 220 inserted between elastic ridge 228 and stopper ridge 230. The shape of curved filter insert frame 220 allows for closer proximity of filter material 226 to the mouth and nostrils which enhances the capture of moisture from exhalations.

Figure 25:
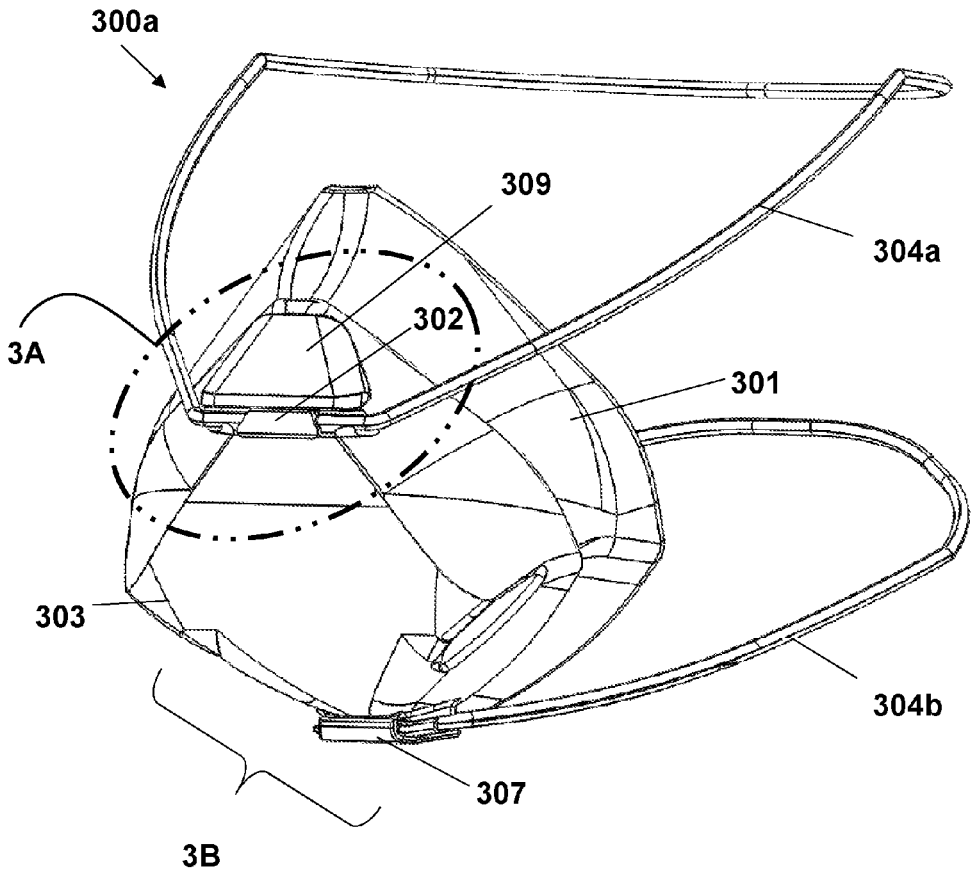
FIG. 25 is perspective view of a fourth facemask assembly.

FIG. 25 shows facemask assembly 300*a* which includes a soft, elastic facemask section 301. Front section 303 has nasal area 3A and chin area 3B. Front section 303 can be made of a hard plastic, among other materials.

Nasal area 3A and chin area 3B have snap-in constructs 302 and 307 configured to accommodate the insertion and extraction of various straps, cords, tubing, and/or O-ring stock such as top strap 304*a* and bottom strap 304*b*. Snap-in constructs 302 and 307 allow straps 304*a* and 304*b* to be replaced and/or decontaminated and re-inserted. In certain embodiments straps 304*a* and 304*b* are of a fixed length. In other embodiments straps 304*a* and 304*b* are open-ended to be tied behind the ears or the head or secured and adjusted via various cord lock systems. In some embodiments nasal snap-in construct 309 allows for an eye shield to be either added or removed from facemask assembly 300*a*.

In some embodiments top strap 304*a* can slide upward to enter into a void which allows top strap 304*a* to slide back and forth to balance the position of any clips and/or buckles (not shown). In some embodiments the combination of both snap-in constructs 302 and 307 allow for both top strap 304*a* and bottom strap 304*b* to be easily removed by reversing the previously snap-in movement.

Turning to chin area 3B, snap-in construct 307 and optional side clips (not shown) help maintain bottom strap 304*b* in place.

Figure 26:
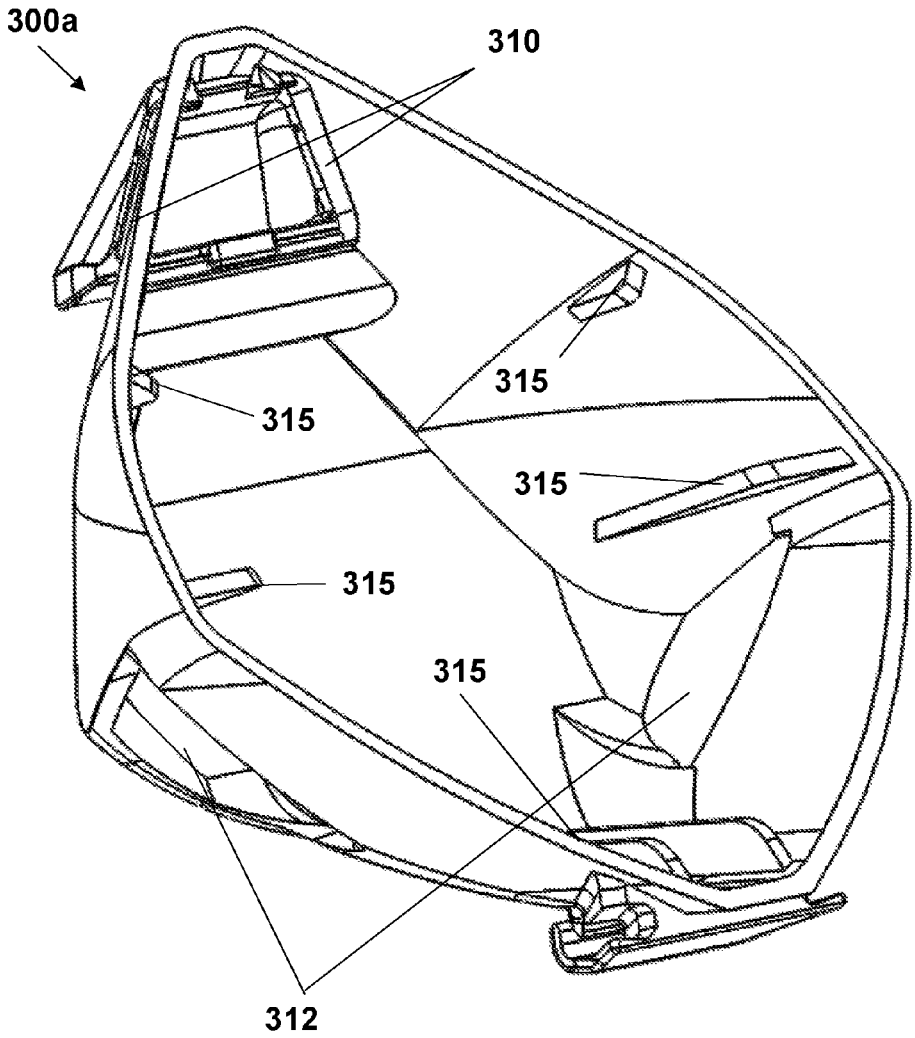
FIG. 26 is a perspective view of the back of the facemask assembly of FIG. 25.

FIG. 26 illustrates a perspective view of facemask assembly 300*a* with the soft elastic face mask section 301 removed. In this embodiment nasal vents 310 allow the escape of exhaled heat and $CO_2$ loaded air. Nasal vents 310 supports improved nose breathability over conventional masks and respirators and accentuates the oblique angle air flow that supports greater capture of air-borne elements within the surface of filter material (not shown). Side vents 312 aid in sending exhaled air backwards and away from those in front of the wearer. Side vents 312, like the nasal vent 310, aid in preventing (or at least reducing) direct frontal contact of airborne particles on to the air filter material.

In certain embodiments stopper extrusions 315 keep the filter insert (not shown) pressed back into the silicone skirt (not shown).

Figure 27:
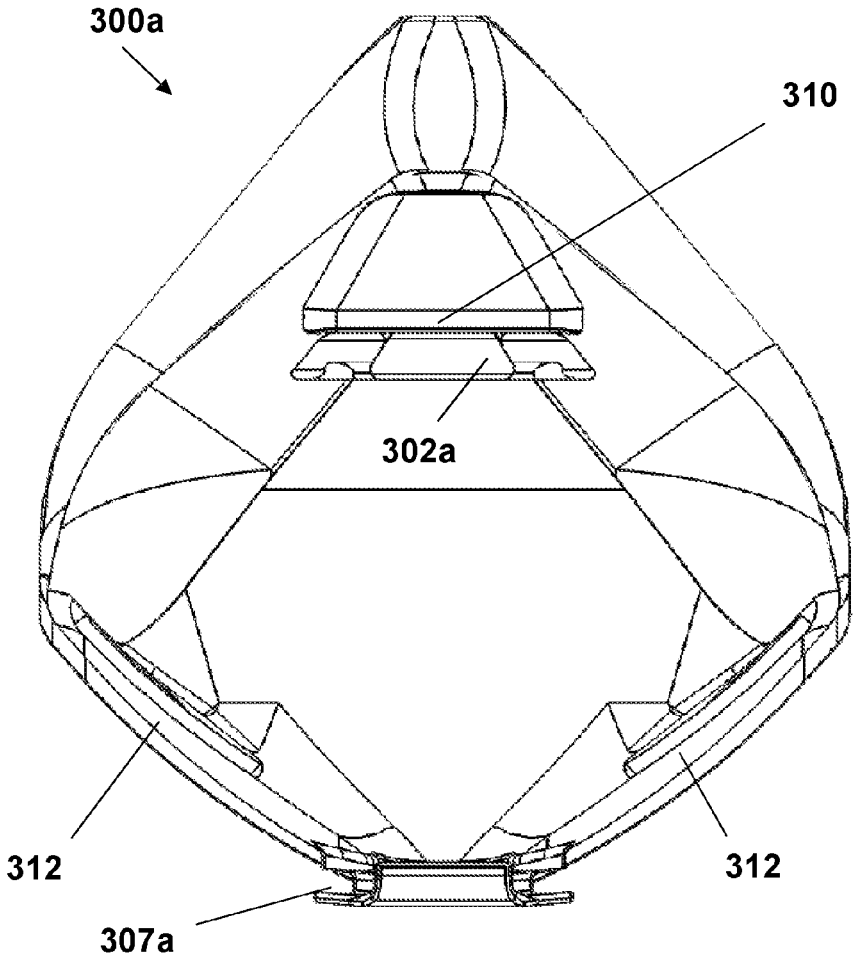
FIG. 27 is a front view of the facemask assembly of FIG. 25.

FIG. 27 is a front view of facemask assembly 300*a*. Snap-in slots 302*a* and 307*a* can be configured to accommodate a wide varies of straps, cords, tubing, and/or O-rings. Facemask assembly 300*a* is configured to reduce, if not completely prevent forward facing air inhalations and exhalations. Additionally, nasal vent 310 and side vents 312 create oblique airflow patterns over filter insert (not shown).

Figure 28:
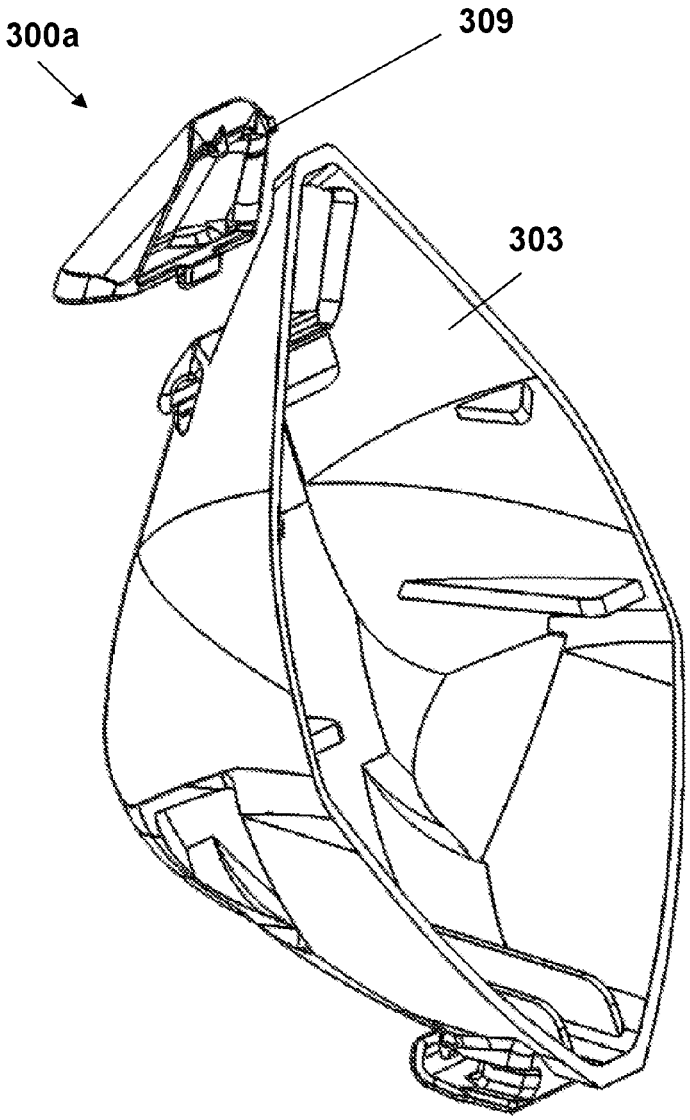
FIG. 28 is an exploded perspective view of the back of the facemask assembly of FIG. 25 with the soft elastic facial skirt removed

FIG. 28 is an exploded perspective view of front section 303 of facemask assembly 300*a* with elastic section 301 removed. Nasal air vent snap-in construct 309 is seen detached from front section 303.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

Furthermore, particular elements (such as the chin strap structure, the head mount pad, the nose bridge clip and the like) of the present invention as described in the embodiments above can be incorporated into facemask assemblies in other suitable combinations or arrangements, for example to suit particular applications.

What is claimed is:

1. A facemask comprising:

(a) a nasal vent configured to allow the escape of exhaled air above the nostril of a user;

(b) a lower side vent configured to direct exhaled air away from the front of said user;

(c) an S-shaped filter insert frame configured to place a filter material near the nose and mouth of a user;

wherein said nasal vent and said lower side vent are configured to direct inhaled air towards said S-shaped filter insert frame at an oblique angle; and (d) a soft elastic section configured to create an airtight seal with said user's face comprising:

(i) an elastic ridge; and (ii) a stopper ridge, wherein said S-shaped filter insert frame is placed between said elastic ridge and said stopper ridge;

(e) a chin section, wherein said chin section has a chin snap-in construct configured to hold a first strap;

(f) a front section; and (g) a nasal area having a nasal snap-in construct configured to hold a second strap.

2. The facemask of claim 1, wherein said filter material is biocidal.

3. The facemask of claim 1, wherein said facemask has no directly front-facing openings.

4. The facemask of claim 1, wherein said S-shaped filter insert frame is flat.

5. The facemask of claim 1, wherein said filter material contains silver.

6. The facemask of claim 1, wherein said S-shaped filter insert frame includes breathing vents.

7. The facemask of claim 1, wherein said filter material has a first active surface and a second active surface.

8. The facemask of claim 1, wherein said filter material is replaceable.

9. The facemask of claim 8, further comprising:

(f) a lock system configured to adjust and secure said first strap behind a user's head.

10. The facemask of claim 1 wherein said nasal snap-in construct is configured to hold an eye shield.

11. The facemask of claim 1, wherein said front section is made of a thin plastic configured to improve the clarity of said user's speech.

* * * * *